US006753815B2

(12) United States Patent
Okubora et al.

(10) Patent No.: US 6,753,815 B2
(45) Date of Patent: Jun. 22, 2004

(54) ANTENNA DEVICE

(75) Inventors: Akihiko Okubora, Kanagawa (JP); Takayuki Hirabayashi, Tokyo (JP); Norikazu Nakayama, Kanagawa (JP); Hiroyuki Arai, 615-11, Imajukuhigashi-cho, Asahi-ku, Yokohama-shi, Kanagawa 241-0032 (JP)

(73) Assignees: Sony Corporation, Tokyo (JP); Hiroyuki Arai, Yokohama (JP)

( * ) Notice: Subject to any disclaimer, the term of this patent is extended or adjusted under 35 U.S.C. 154(b) by 0 days.

(21) Appl. No.: 10/275,244

(22) PCT Filed: Mar. 5, 2002

(86) PCT No.: PCT/JP02/02038

§ 371 (c)(1),
(2), (4) Date: Jan. 16, 2003

(87) PCT Pub. No.: WO02/071542

PCT Pub. Date: Sep. 12, 2002

(65) Prior Publication Data

US 2004/0027288 A1 Feb. 12, 2004

(30) Foreign Application Priority Data

Mar. 5, 2001 (JP) ..... 2001-060788

(51) Int. Cl.[7] ..... H01Q 1/38
(52) U.S. Cl. ..... 343/700 MS; 343/702
(58) Field of Search ..... 343/700 MS, 702, 343/846, 848, 829

(56) References Cited

U.S. PATENT DOCUMENTS 6,034,636 A * 3/2000 Saitoh ..... 343/700 MS
6,255,994 B1 * 7/2001 Saito ..... 343/700 MS

FOREIGN PATENT DOCUMENTS

| | | |
|---|---|---|
| EP | 993 070 | 4/2000 |
| JP | 63-62402 | 3/1988 |
| JP | 06-284036 | 7/1994 |
| JP | 06-224618 | 8/1994 |
| JP | 08-321716 | 3/1996 |
| JP | 09-93030 | 4/1997 |
| JP | 10-190345 | 7/1998 |
| JP | 11-136025 | 5/1999 |
| JP | 2000-68726 | 3/2000 |
| JP | 2000-11485 | 4/2000 |

* cited by examiner

*Primary Examiner*—Hoang V. Nguyen
(74) *Attorney, Agent, or Firm*—Sonnenschein, Nath & Rosenthal LLP

(57) ABSTRACT

The present invention is an antenna apparatus attached to an electronic device and includes an antenna section (11) having an antenna element (18) provided with two or more power supply points (19) and two or more earth points (20); and an earth point switch (21) which is provided correspondingly to each earth point (20) and connects or disconnects the earth point (20) from a ground. Selectively turning on or off the earth point switch (21) selects the earth point to adjust the resonance frequency.

15 Claims, 16 Drawing Sheets

ANTENNA DEVICE

BACKGROUND OF THE INVENTION

The present invention relates to an antenna apparatus. More specifically, the present invention relates to an antenna apparatus appropriately used for an ultra small communication module installed in various electronic devices such as personal computers, portable telephones, audio devices, etc. having an information communication capability, a data storage capability, etc.

Owing to digitization of information signals, various types of information such as audio information, image information, etc. can be easily handled on personal computers, mobile devices, etc. Audio and image codec technologies are used to promote the band compression of these types of information. The digital communication and the digital broadcasting are creating an environment to easily and efficiently deliver such information to various communication terminal devices. For example, audio video data (AV data) can be received on a portable telephone.

A system for sending and receiving data is being widely used in various places including homes in accordance with a proposal for simple communication network systems available in small areas. As a communication network system, special attention is paid to, for example, a 5 GHz band narrow-area wireless communication system proposed in the IEEE802.11a, a 2.45 GHz band wireless LAN system proposed in the IEEE802.11b, and a next-generation wireless communication system such as so-called Bluetooth and other short-range wireless communication systems.

The above-mentioned various electronic devices require interface specifications capable of connection to all communication networks. A wireless communication means is provided to even mobile electronic devices exclusively for personal use, enabling communication with various devices and systems in a mobile situation for interchanging data and the like. For connection with other devices, the mobile electronic device is provided with a wireless communication function such as a plurality of wireless communication ports, wireless communication hardware, etc. having interface functions compliant with the associated communication systems.

Digitization of AV data enables to easily record and store data on personal computer's storage devices using recording media such as hard discs, optical discs including magnet-optical discs, semiconductor memory, etc. The recording media used for these types of storage devices are generally being used in place of recording media according to conventional analog recording systems such as audio or video tape cassettes, video discs, etc. having proprietary formats. Particularly, semiconductor memory chips such as flash memory are characterized by a very small cubic volume per recording capacity and ease of attaching or detaching from devices. For example, semiconductor memory chips are used for various electronic devices such as digital still cameras, video cameras, portable audio devices, notebook computers, etc.

The semiconductor memory chip helps easily move, record, store, etc. data such as audio or image information between the electronic devices. In order to move, transport, or store data, however, the semiconductor memory chip generally needs to be attached or detached from the device, causing a troublesome operation.

As mentioned above, a plurality of wireless communication functions are provided to various electronic devices.

Generally, it is enough to use one function according to the usage condition, environment, etc. There is hardly a case of using a plurality of functions at a time. Because of a plurality of functions provided, the electronic devices have been subject to a problem of a cross talk or a radio interference with each other in the same or different frequency bands. Particularly, a mobile electronic device impairs the portability by mounting wireless communication ports, wireless communication hardware, etc. to provide wireless communication functions corresponding to the above-mentioned plurality of communication systems.

The electronic device provides the wireless communication function by attaching a wireless communication module having the storage function and the wireless communication function using semiconductor memory. This type of mobile electronic devices can comply with various communication systems and decrease the structural complexity by attaching appropriately selected wireless communication modules compliant with various communication systems.

FIGS. 1 and 2 show a configuration of wireless communication module used for a mobile electronic device. A wireless communication module 200 as shown in FIGS. 1 and 2 comprises a printed circuit board 201 where an appropriate wiring pattern is formed on one surface and a ground pattern 202 is formed on the other surface. There are mounted an RF module 203, an LSI 204 constituting a signal processing section, a flash memory element 205, a transmitter 206, etc. The wireless communication module 200 is mounted with a connector 207 for connection with the device at one end on the other surface of the printed circuit board 201. The wireless communication module 200 contains an antenna section 208 patterned at one end of the wiring pattern surface opposite the connector 207 on the printed circuit board 201.

The wireless communication module 200 is attached to or detached from the main device such as a mobile device via the connector 207 to store data and the like supplied from the main device in the flash memory element 205 and transfer data and the like stored in the flash memory element to the main device. When attached to the main device, the wireless communication module 200 uses the externally protruded antenna section 208 to enable wireless interchange of signals between the main device and a host device or a wireless system for wireless connection with the main device.

The antenna section 208 is patterned on a principal plane of the printed circuit board 201. For miniaturization of the wireless communication module 200, the antenna section 208 comprises a monopole antenna as a built-in antenna having a relatively simple structure. For example, a so-called reverse F-shaped antenna as shown in FIG. 1 is used for the antenna section 208. The reverse F-shaped antenna comprises an antenna element 209 formed along the width direction of the printed circuit board 201 at one end, an earth pattern 210, and a power supply pattern 211. The earth pattern 210 is formed orthogonally to the antenna element 209 at its one end and is short-circuited to the ground pattern 202. The power supply pattern 211 is formed parallel to the earth pattern 210, orthogonally to the antenna element 209, and is supplied with power from the RF module 203, for example. The reverse F-shaped antenna allows the main polarized wave direction to cross the antenna element 209 at the right angle.

The antenna section 208 may use not only the stick antenna element 209 formed as a pattern on the printed circuit board 201, but also a plate antenna element 215 as shown in FIG. 3. The antenna element 215 may be patterned on the principal plane of the printed circuit board 201, but also be mounted in a lifted manner from the principal plane of the printed circuit board 201 as shown in FIG. 3. At one end of the antenna element 215, there are provided an earth section 216 connected to the ground pattern 202 and a power supply point 217.

As shown in FIG. 4, the antenna section 208 may be configured as a so-called reverse L-shaped antenna by forming a power supply section 219 orthogonally to one end of the antenna element 218. The antenna section 208 may be configured to be, e.g., a loop pattern antenna, a micro-split pattern antenna, etc. as the other monopole antennas.

The wireless communication module 200 promotes miniaturization by providing the above-mentioned antenna section 208, but may greatly change antenna characteristics depending on states of attaching the module to the main device. The wireless communication module 200 is attached to or detached from various electronic devices for use. States of the electromagnetic field near the antenna element vary with the ground surface size of the main device, a case material, a dielectric constant, etc. Accordingly, the wireless communication module 200 is subject to a large change in antenna characteristics such as a resonance frequency, a band, sensitivity, etc.

To solve these problems, the wireless communication module 200 needs to mount an antenna apparatus with wideband characteristics for providing the sufficient sensitivity in an intended frequency band corresponding to characteristics of all main devices used. Basic characteristics of the antenna apparatus depend on the cubic volume. It is very difficult to configure the antenna apparatus so as to provide the sufficient wideband characteristics while maintaining the miniaturization. Therefore, the antenna apparatus has been a hindrance to miniaturization of the wireless communication module with good radio characteristics.

SUMMARY OF THE INVENTION

The present invention has been made in consideration of the foregoing. It is therefore an object of the present invention to provide an antenna apparatus capable of eliminating the need for adjustment independently of usage conditions, implementing wideband characteristics for good wireless communication, and achieving the miniaturization.

To achieve the above-mentioned objects, the antenna apparatus according to the present invention provides an antenna section having an antenna element provided with at least two or more power supply points and at least two or more earth points; a power supply point selection switch which is provided for each of the power supply points and connects or disconnects each power supply point from a power supply section; and an earth point switch which is provided for each of the power supply points and connects or disconnects each earth point from a ground.

In the antenna apparatus according to the present invention, a resonance frequency is adjusted by allowing one of the power supply point and the earth point to be fixed and the other to be movable, and selecting the power supply point or the earth point which is made to be movable by a selection operation of the power supply point selection switch or the earth point switch.

The antenna apparatus according to the present invention varies the center resonance frequency for its optimization by changing a power supply point or an earth point even in case of a change in conditions for attachment to an electronic device to which the apparatus is attached, a change in environmental conditions, etc. When used for various electronic devices, the antenna apparatus can interchange data and the like under good conditions by eliminating the need for adjustment. This antenna apparatus can be also used for a so-called multiband communication device capable of compliance with various communication systems having different communication frequency bands and promote miniaturization and cost saving of the device.

The antenna apparatus according to the present invention comprises an antenna section having an antenna element provided with a power supply point and at least two or more earth points; an earth point switch means which is provided for each of the earth points and connects or disconnects each earth point from a ground; and an impedance adjustment means which is provided for the power supply point and performs impedance matching. In the antenna apparatus, a selection operation of the earth point switch means selects the earth points and adjusts a resonance frequency, and the impedance adjustment means performs optimal impedance matching corresponding to the adjusted resonance frequency.

This antenna apparatus also varies the center resonance frequency for its optimization by changing a power supply point or an earth point even in case of a change in conditions for attachment to an electronic device to which the apparatus is attached, a change in environmental conditions, etc. The antenna apparatus can interchange data and the like under good conditions by using an impedance adjustment means for optimal impedance matching. Even when a low-cost substrate is used, this antenna apparatus can implement miniaturization and provide optimal impedance matching. The antenna apparatus can be used for a so-called multiband communication device capable of compliance with various communication systems having different communication frequency bands and promote miniaturization and cost saving of the communication device itself. Further, the antenna apparatus according to the present invention can be attached to various electronic devices and configure a small, lightweight, and user-friendly wireless communication module for providing an excellent communication function in addition to a storage function and a wireless communication function.

The foregoing and other advantages and features of the present invention will become more apparent from the detailed description of the preferred embodiments of the invention given below with reference to the accompanying drawings.

BRIEF DESCRIPTION OF THE DRAWINGS

FIG. 13C is a longitudinal sectional view showing the MEMS switch turned on;

BEST MODE FOR CARRYING OUT THE INVENTION

Embodiments of the antenna apparatus according to the present invention will be described in further detail with reference to the accompanying drawings.

Figure 5:
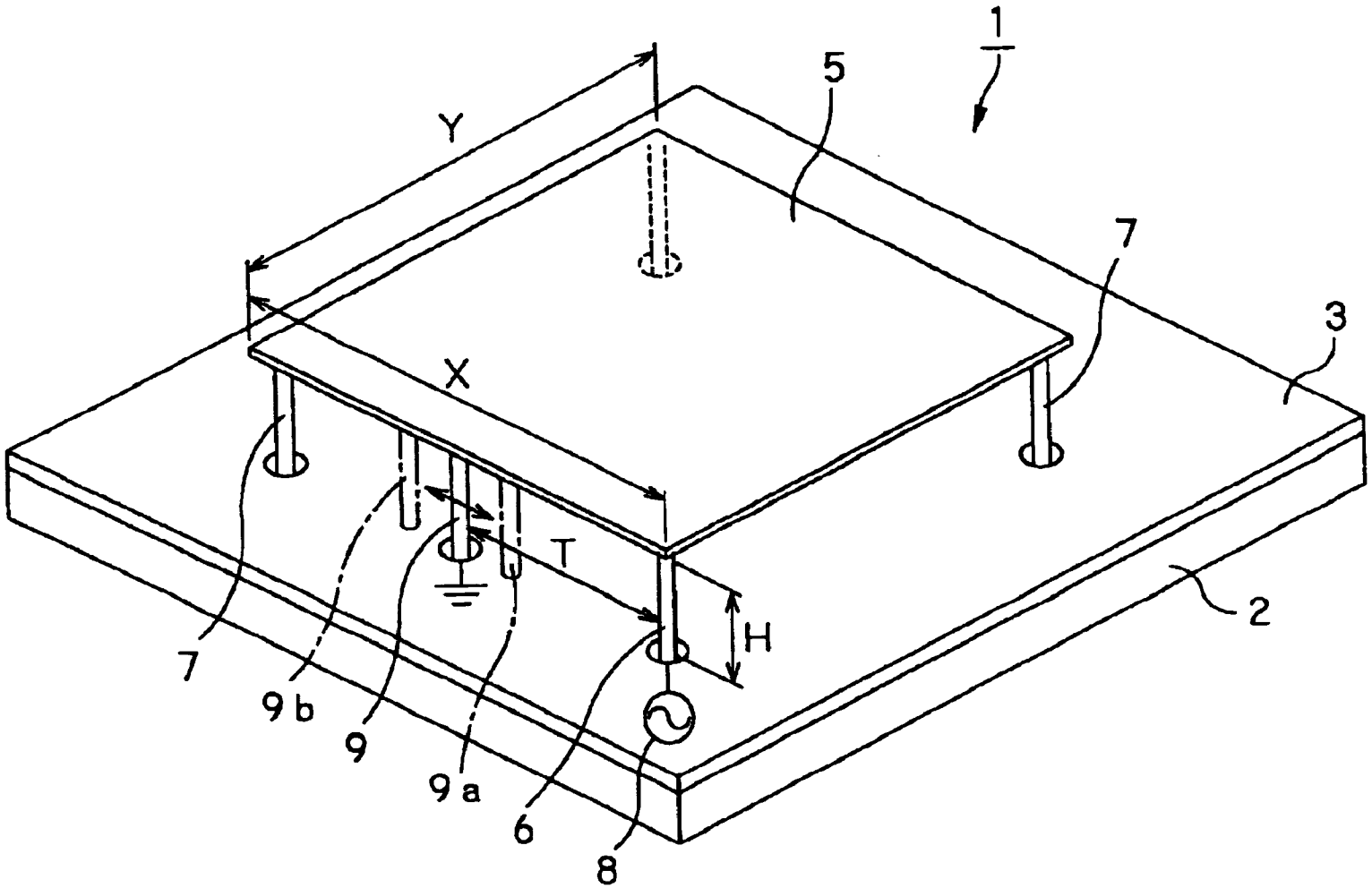
FIG. 5 is a perspective view showing an antenna apparatus according to the present invention.

The antenna apparatus according to the present invention is attached to an electronic device (hereafter referred to as a main device) such as a personal computer, for example. The antenna apparatus is used for a card-type wireless communication module which provides the main device with a storage function and a wireless communication function. An antenna apparatus 1 has a printed circuit board 2 configured as shown in FIG. 5. There are formed a high-frequency circuit section, a power supply circuit section, etc. inside the printed circuit board 2. As shown in FIG. 5, a ground pattern 3 is formed overall on one surface of the printed circuit board 2. On the other surface, i.e., on the rear surface thereof, there are formed, though not shown, an RF module, an LSI chip constituting a signal processing section, a flash memory element, a transmitter, etc. A flat antenna element 5 is mounted on the printed circuit board 2 and is supported by a power supply pin 6 and a plurality of support pins 7. Supported by the power supply pin 6 and the support pins 7, the flat antenna element 5 is raised for a specified height H from the printed circuit board 2. The flat antenna element 5 is supplied with power from the RF module etc. (not shown), as a power supply 8, mounted on the rear surface of the printed circuit board 2 via the power supply pin 6. The flat antenna element 5 is grounded to the ground pattern 3 via an earth pin 9 separated from the power supply pin 6 for a specified distance T. The earth pin 9 is attached to the flat antenna element 5 with the distance T which is variable with reference to the power supply pin 6. The flat antenna element 5 forms a dipole corresponding to the ground pattern 3 on the printed circuit board 2 and radiates, from its principal plane, communication power supplied from the power supply pin 6 at a specified resonance frequency.

Figure 6:
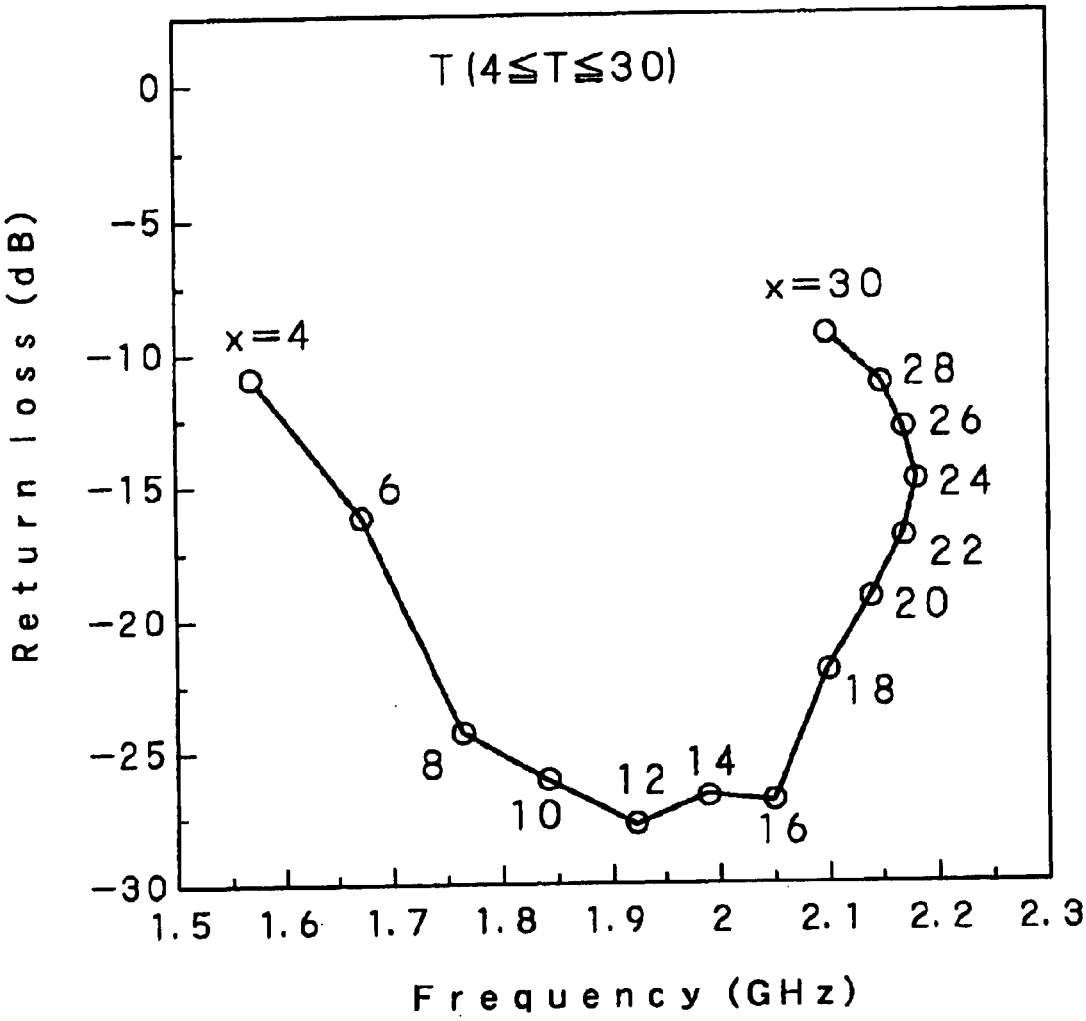
FIG. 6 is a characteristic chart showing a state of resonance frequency changes when an earth point position is changed on the antenna apparatus according to the present invention.

The antenna apparatus 1 varies a resonance frequency by changing the distance T between the earth pin 9 and the power supply pin 6. On the antenna apparatus 1 according to the present invention, the flat antenna element 5 has lengths of 30 mm along the X axis and 20 mm along the Y axis. There is the 4 mm interval H between the flat antenna element 5 and the ground pattern 3 on the printed circuit board 2. The position of the earth pin 9 is varied in a range indicated by dot-dash lines 9*a* and 9*b* to vary the distance T between the power supply pin 6 and the earth pin 9 within a range from 4 mm to 30 mm. Under these conditions, FIG. 6 shows changes of a minimum center resonance frequency $f_0$ of return losses from the flat antenna element 5. Here, the return loss signifies a ratio of transmission power applied to the flat antenna element 5 via the power supply pin 6 and returned therefrom.

As the return loss causes a large frequency toward the negative side, the antenna apparatus 1 according to the present invention generates the resonance on the flat antenna element 5 to efficiently radiate a radio wave. The antenna apparatus 1 provides a good antenna characteristic when the minimum center resonance frequency $f_0$ shows a "return loss value minus 10 dB" or less. Accordingly, as is apparent from FIG. 6, the antenna apparatus 1 according to the present invention can vary the minimum center resonance frequency $f_0$ for approximately 650 MHz from 1.55 GHz to 2.2 GHz by moving the position of the earth pin 9 with reference to the power supply pin 6.

Figure 7:
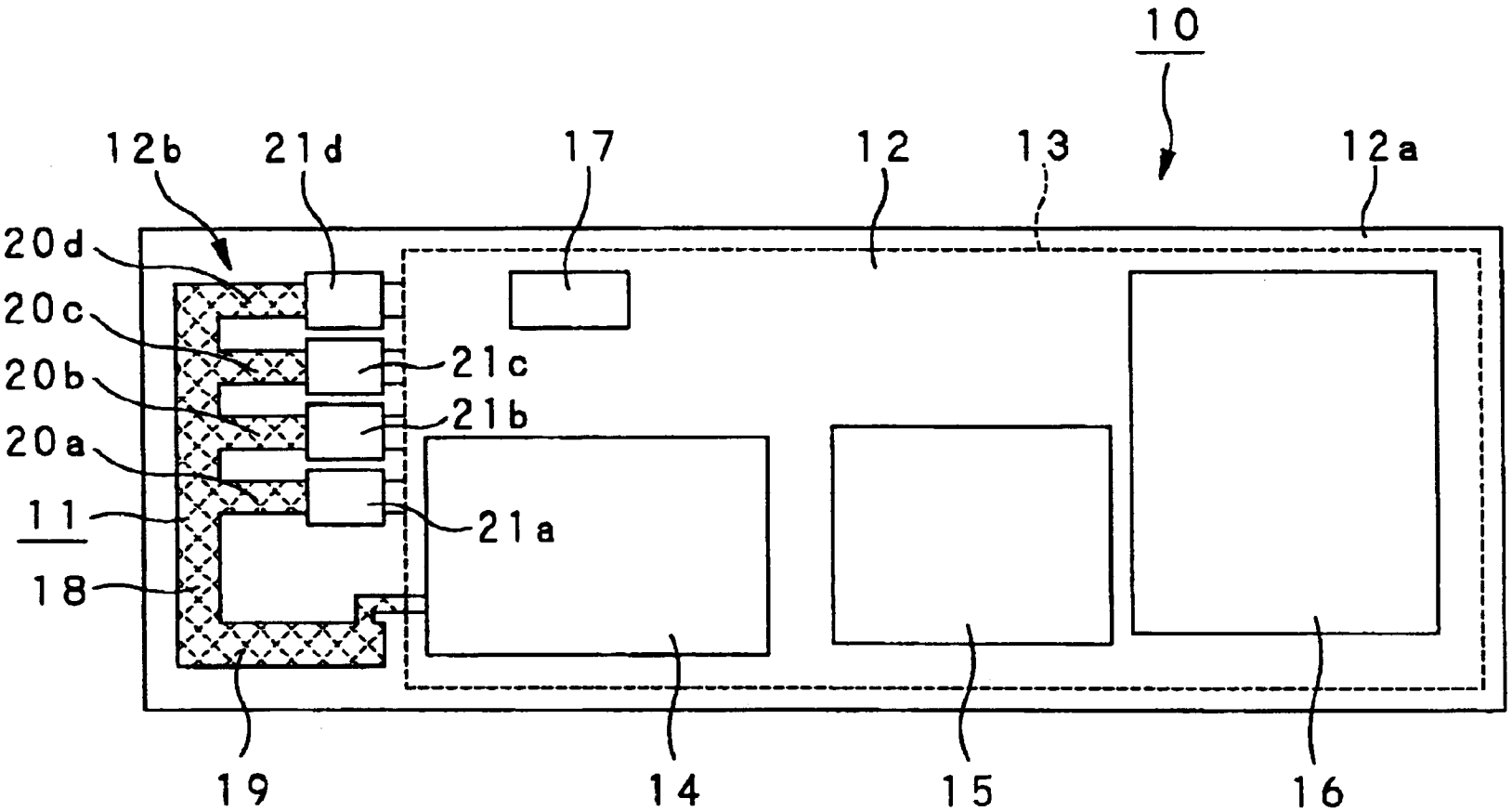
FIG. 7 is a top view showing a wireless communication module having an antenna apparatus according to the present invention.

The following describes a wireless module 10 for an antenna section 11 implementing the basic configuration of the above-mentioned antenna apparatus 1. As shown in FIG. 7, the wireless module 10 is formed rectangularly. On one principal plane 12*a*, there is provided a multilayer printed circuit board 12 on which a wiring pattern is formed (not shown). On the multilayer printed circuit board 12, one end of the principal plane 12*a* is used as an antenna formation area 12*b* where the antenna section 11 is configured. Inside the board, there is formed a ground pattern 13 indicated by a shaded portion in FIG. 7 except an area corresponding to the antenna formation area 12*b*. Though details are omitted, a high-frequency circuit section is formed in the multilayer printed circuit board 12, and a power supply pattern section is formed on the other principal plane. A connector (not shown) is provided at one end of the other principal plane of the multilayer printed circuit board 12. Via this connector, connection is made to the main device such as a mobile device. There are mounted an RF module 14, an LSI 15 constituting the signal processing section, a flash memory element 16, and a transmitter 17 on the wiring pattern section of the multilayer printed circuit board 12. The antenna section 11 is basically formed to be a reverse L-shaped pattern and is patterned in the antenna formation area 12*b* on the multilayer printed circuit board 12.

The wireless communication module 10 is attached to the main device to provide various main devices with the storage function and the wireless communication function. Via a wireless network system, the wireless communication module 10 enables wireless transmission of data signals and the like between constituent devices. The wireless communication module 10, when unneeded, is detached from the main device. The wireless communication module 10 provides functions of sending and receiving data signals and the like through connection with the Internet, for example, and supplying the received data signals and music information to the main device and other devices constituting the wireless network. By using the high-performance antenna section 11, the wireless communication module 10 can highly accurately perform the above-mentioned wireless transmission of information.

Figure 8:
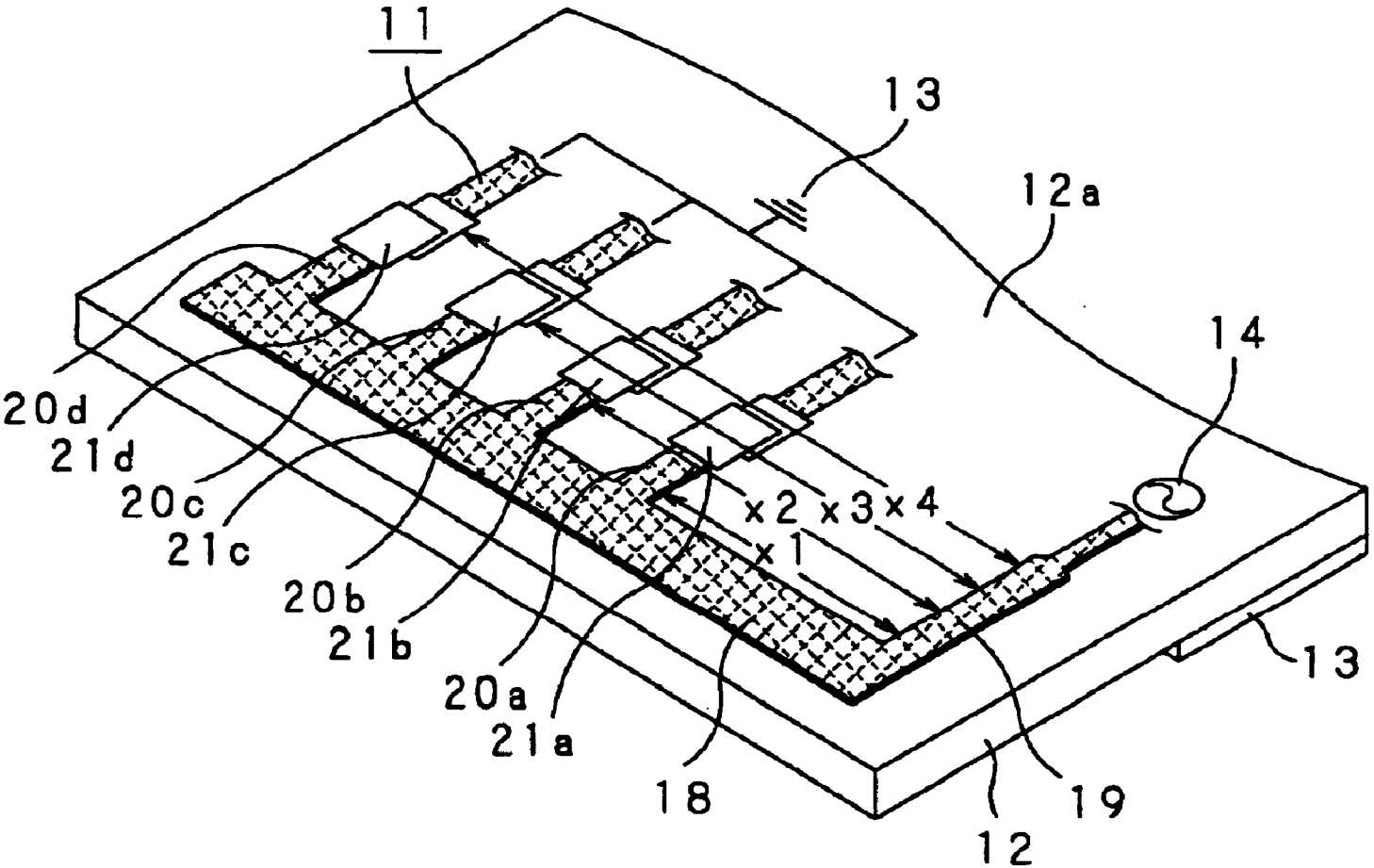
FIG. 8 is a fragmentary perspective view showing an antenna section of the wireless communication module.

As shown in FIG. 8, the antenna section 11 comprises an antenna element pattern 18, a power supply pattern 19, four earth patterns 20, and four earth selection switches 21. The stick-shaped antenna element pattern 18 is formed along one edge of the multilayer printed circuit board 12. The power supply pattern 19 is formed at one end of the antenna element pattern 18 orthogonally thereto. The four earth patterns 20 are formed at an opening end of the antenna element pattern 18 parallel to the power supply pattern 19 and orthogonally to the antenna element pattern 18. The antenna section 11 supplies power to the antenna element pattern 18 by means of a pattern connection between the power supply pattern 19 and the RF module 14.

In the antenna section 11, as shown in FIG. 8, the earth pattern 20 comprises a first earth pattern 20*a* through a fourth earth pattern 20*d* parallel to each other. In the antenna section 11, the first earth pattern 20*a* through the fourth earth pattern 20*d* are provided with a first earth selection switch 21*a* through a fourth earth selection switch 21*d*, respectively, so as to enable or disable connection with the ground pattern 13. The antenna section 11 selectively opens or closes the first earth selection switch 21*a* through the fourth earth selection switch 21*d* to short-circuit or open the first earth pattern 20*a* through the fourth earth pattern 20*d* for the ground pattern 13. The antenna section 11 selects the first earth pattern 20*a* through the fourth earth pattern 20*d* by means of the first earth selection switch 21*a* through the fourth earth selection switch 21*d* for a short circuit to the ground pattern 13. This varies the distance T between the power supply pattern 19 and the earth pattern 20 as mentioned above for the antenna apparatus 1. As shown in FIG. 8, the antenna section 11 is configured to specify distance x1 to be 8 mm between the power supply pattern 19 and the first earth pattern 20*a*, distance x2 to be 12 mm between the same and the second earth pattern 20*b*, distance x3 to be 16 mm between the same and the third earth pattern 20*c*, and distance x4 to be 20 mm between the same and the fourth earth pattern 20*d*.

Figure 9:
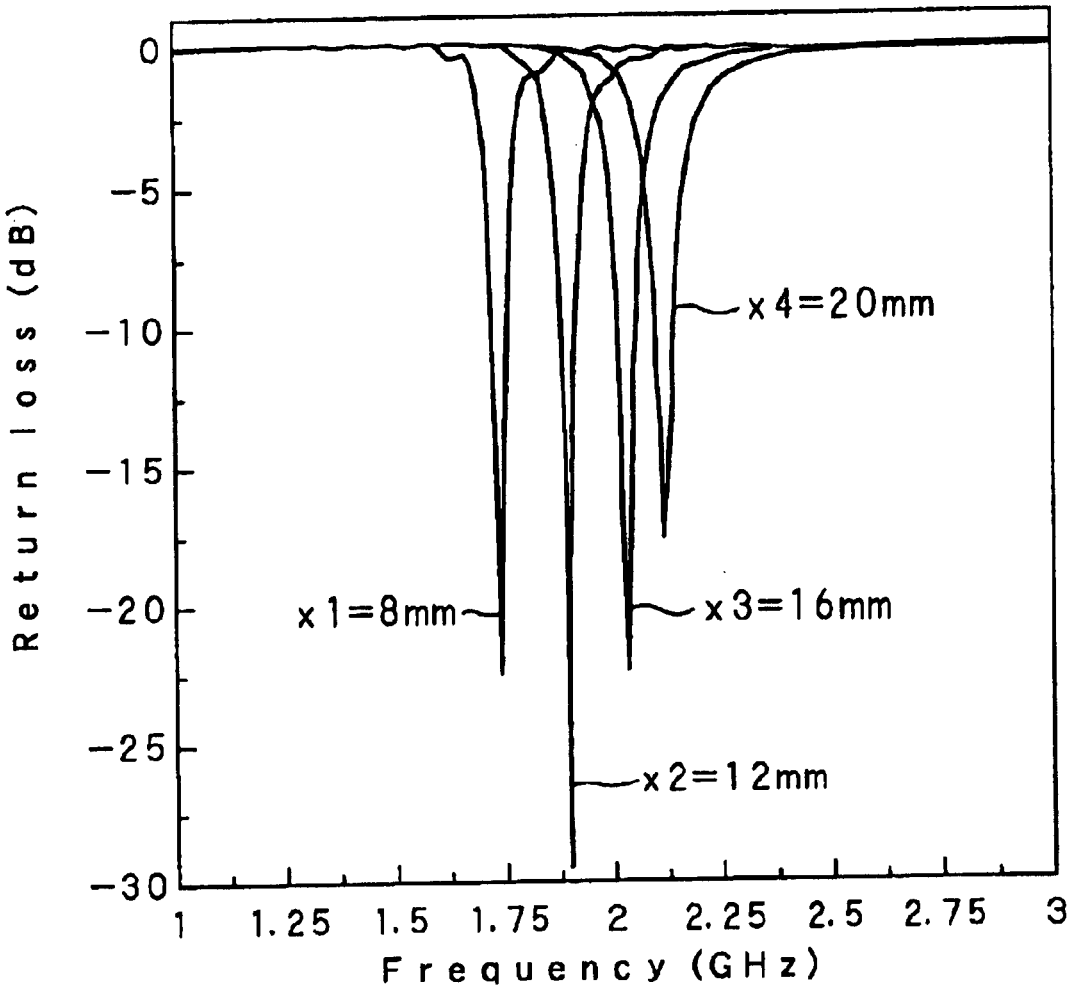
FIG. 9 is a characteristic chart showing a state of resonance frequency changes when each earth point selection switch is operated on the antenna apparatus according to the present invention.

The antenna section 11 having the above-mentioned configuration individually turns on the first earth selection switch 21*a* through the fourth earth selection switch 21*d* and individually short-circuits the first earth pattern 20*a* through the fourth earth pattern 20*d* to the ground pattern 13. In this case, return losses result as shown in FIG. 9. The antenna section 11 adjusts the distance T between the earth pattern 20 and the power supply pattern 19 by selecting the first earth selection switch 21*a* through the fourth earth selection switch 21*d*. As shown in FIG. 9, the antenna section 11 adjusts the resonance frequency band in the range between 1.75 GHz and 2.12 GHz.

The wireless communication module 10 is attached to various types of electronic devices and the like as mentioned above to connect these devices to an applicable network system. The above-mentioned antenna section 11 adjusts the wireless communication module 10 when the resonance frequency changes due to a main device's case material, a substrate size, a ground surface configuration, etc. or when the wireless communication module 10 is used for a different wireless communication system. Using software processing, for example, the wireless communication module 10 controls operations of the first earth selection switch 21*a* through the fourth earth selection switch 21*d* according to a control signal supplied from a reception system and automatically adjusts the resonance frequency.

Figure 10:
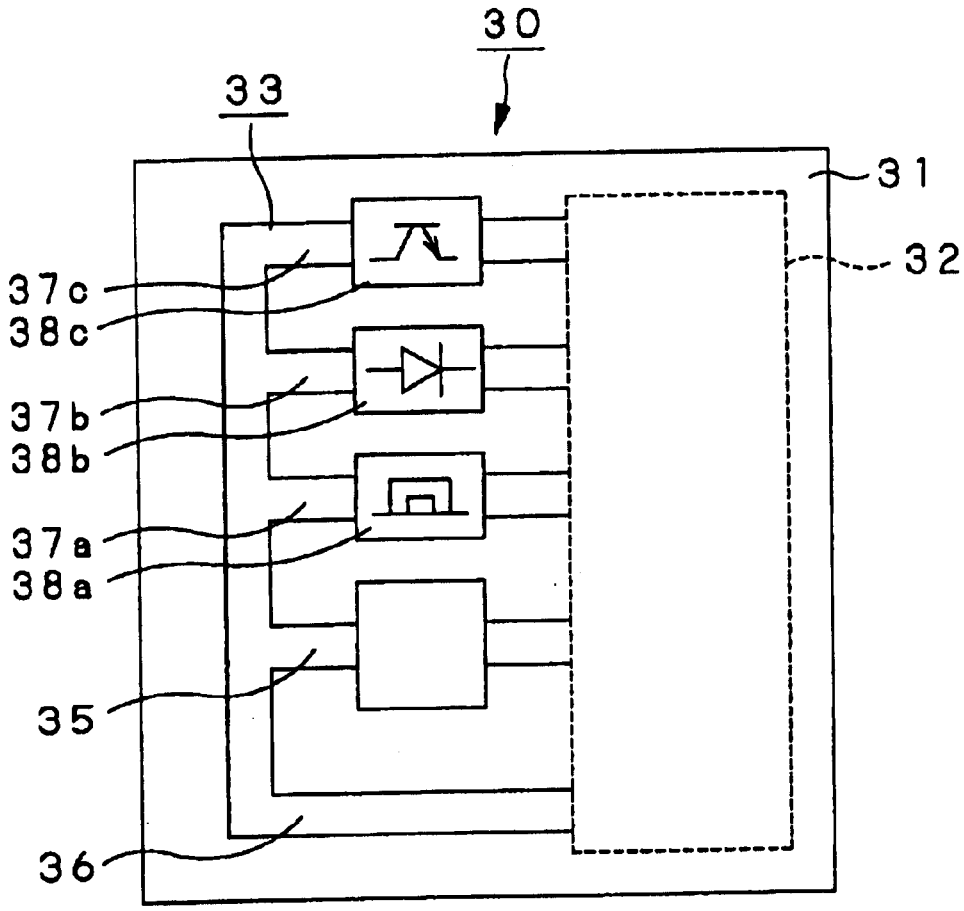
FIG. 10 is a top view showing an antenna section constituting the antenna apparatus according to the present invention.

The following describes another example of the antenna apparatus according to the present invention. As shown in FIG. 10, an antenna apparatus 30 contains an antenna section 33 patterned on a printed circuit board 31 where a ground pattern 32 is formed. The antenna apparatus 30 contains a power supply pattern 35 formed orthogonally to an antenna element pattern 34. There are patterned a fixed earth pattern 36 and three selection earth patterns 37*a* through 37*c* each short-circuited to the ground pattern 32 so as to sandwich the power supply pattern 35 therebetween. In the antenna apparatus 30, each selection earth pattern 37 is short-circuited to the ground pattern 32 via the earth selection switches 38*a* through 38*c*.

As mentioned above, the antenna apparatus 30 selects the earth selection switch 38 to short-circuit any of the three selection earth patterns 37 to the ground pattern 32. This changes a distance between the selection earth pattern 37 and the power supply pattern 35 to adjust the resonance frequency. The antenna apparatus 30 uses, e.g., an MEMS switch (Micro-Electro-Mechanical-System switch) 38*a* (to be detailed later) for each of the earth selection switches 38. The antenna apparatus 30 uses, e.g., a semiconductor switch 38*b* having a diode for each of the earth selection switches 38. The antenna apparatus 30 uses, e.g., a semiconductor switch 38*c* having a transistor or the like as the other active elements for each of the earth selection switches 38.

While the antenna apparatus 30 in FIG. 10 is provided with the three selection earth patterns 37 and the three earth selection switches 38, the present invention is not limited thereto. Any number of selection earth patterns 37 and earth selection switches 38 may be provided based on specifications such as adjustment ranges and adjustment phases of the resonance frequency, effects of the adjustment, costs, spaces, etc.

Figure 11:
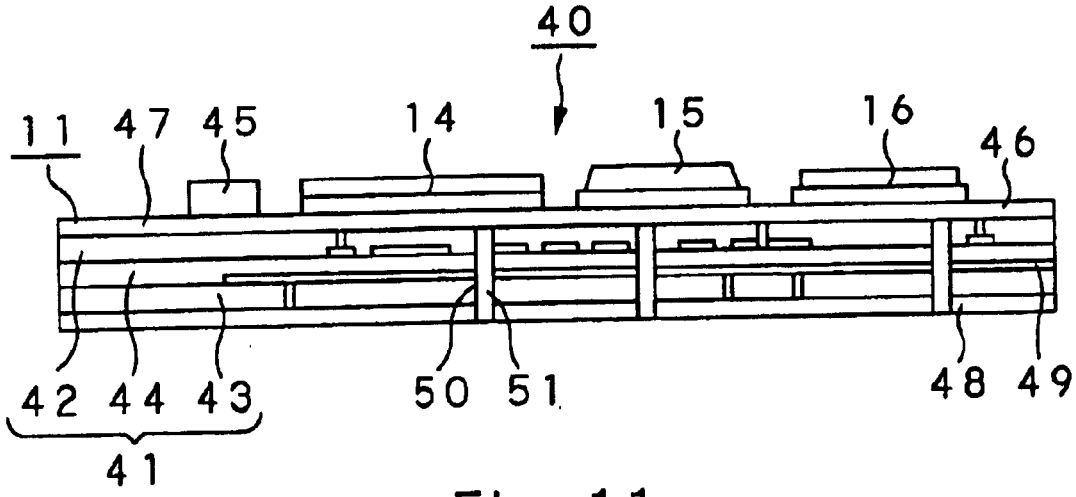
FIG. 11 is a longitudinal sectional view showing a wireless communication module having the antenna apparatus according to the present invention.

FIG. 11 shows another example of the wireless communication module 40. As shown in FIG. 11, the wireless communication module 40 contains the above-mentioned antenna section 11 formed on a multilayer printed circuit board 41. The wireless communication module 40 contains a wiring pattern 46 formed on one principal plane of the multilayer printed circuit board 41 comprising a first double-sided substrate 42 and a second double-sided substrate 43 bonded to each other with prepreg 44 therebetween. On this principal plane, there are mounted the RF module 14, the LSI 15 constituting the signal processing section, the flash memory element 16, etc. The wireless communication module 40 is provided with the above-mentioned antenna section 11 by patterning an antenna pattern 47 in an area at one end of the multilayer printed circuit board 41. The wireless communication module 40 is provided with a power supply pattern 48 formed on the other principal plane of the multilayer printed circuit board 41 and a ground pattern 49 formed inside. The wireless communication module 40 supplies power to the above-mentioned mounted components via a plated through hole layer 51 of many through holes 50 formed by piercing through the multilayer printed circuit board 41 and provides connection to the ground.

With reference to FIGS. 12A through 12E, the following describes a manufacturing process of the wireless communication module 40.

Figure 12A:
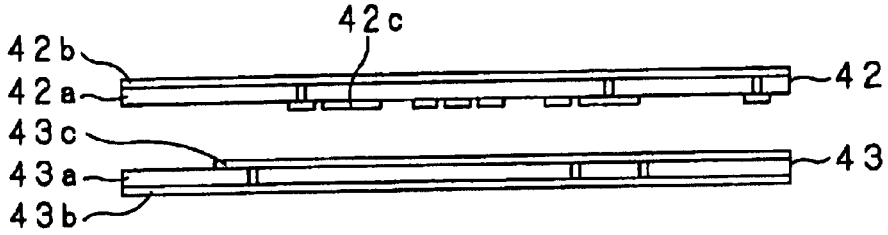
FIGS. 12A to 12E are process drawings showing a manufacturing process of the wireless communication module.

To manufacture the wireless communication module 40, there are prepared the first double-sided substrate 42 and the second double-sided substrate 43 as shown in FIG. 12A. The first double-sided substrate 42 has a copper foil 42*b* bonded on one principal plane of a substrate 42*a*. An internal circuit pattern 42*c* is formed on the other principal plane of the substrate 42*a* to be used as a laminating surface with the second double-sided substrate 43. The first double-sided substrate 42 makes connection between the internal circuit pattern 42*c* and the copper foil 42*b* via many through holes formed in the substrate 42*a*.

Likewise, the second double-sided substrate 43 has a copper foil 43*b* bonded on one principal plane of a substrate 43*a*. An internal circuit pattern 43*c* is formed on the other principal plane of the substrate 43*a* to be used as a surface bonded to the first double-sided substrate 42. When the second double-sided substrate 43 is bonded to the first double-sided substrate 42, the internal circuit pattern 43*c* comprises the ground pattern 49 formed all over the area except the portion corresponding to the antenna section 11.

Figure 12B:
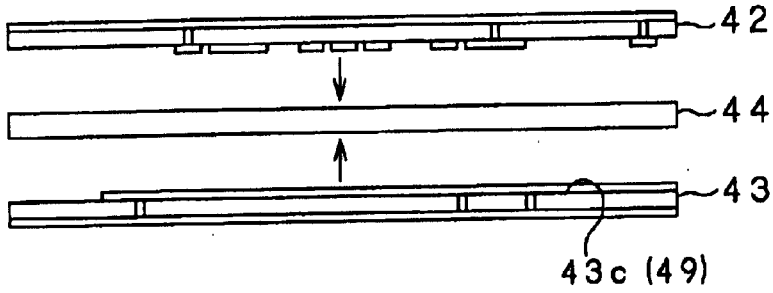
Figure 12C:
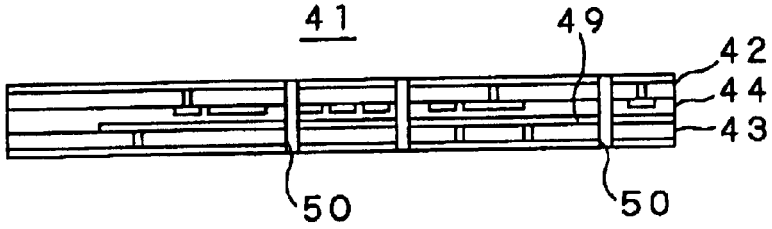
Figure 12D:
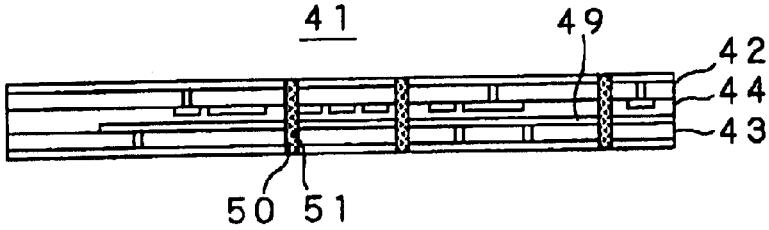

As shown in FIG. 12B, the first double-sided substrate 42 and the second double-sided substrate 43 are stacked with the prepreg 44 placed between the opposite laminating surfaces. With this state, these substrates are heat-pressed for an integrated combination to form an intermediate for the multilayer printed circuit board 41. As shown in FIG. 12C, drilling, a laser process, etc. are applied to the intermediate for the multilayer printed circuit board 41 to form many through holes 50 piercing the first double-sided substrate 42 and the second double-sided substrate 43. As shown in FIG. 12D, through hole plating is applied to an inner wall of each through hole 50 in the intermediate for the multilayer printed circuit board 41 to form the plated through hole layer 51. Thus, connection is made between the copper foil 42*b* on the first double-sided substrate 42 and the copper foil 43*b* on the second double-sided substrate.

Figure 12E:
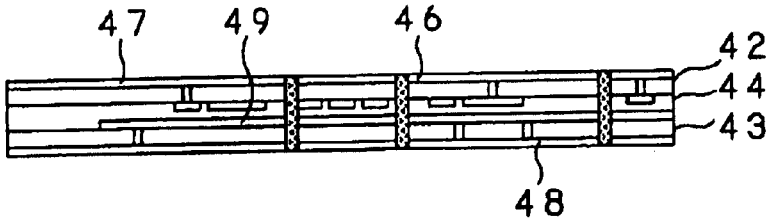

Specified patterning processes are applied to the copper foil 42*b* on the first double-sided substrate 42 and to the copper foil 43*b* on the second double-sided substrate 43 on the intermediate for the multilayer printed circuit board 41. As shown in FIG. 12E, the specified wiring pattern 46 and the antenna pattern are formed on the first double-sided substrate 42. The power supply pattern 48 is formed on the second double-sided substrate 43. The intermediate for the multilayer printed circuit board 41 includes the above-mentioned components mounted on the wiring pattern 46 of the first double-sided substrate 42 to configure the wireless communication module 40.

The manufacturing method of the wireless communication module 40 is not limited to the above-mentioned process. It is possible to use conventional manufacturing processes for various multilayer printed circuit boards. Much more double-sided substrates can be used for the multilayer printed circuit board 41 as needed. The use of a material having a large specific inductive capacity for the multilayer printed circuit board 41 shortens the equivalent wavelength and is effective for miniaturization of the wireless communication module 40. According to impedance matching to be described later, it is also possible to use substrates of a material having a small dielectric constant.

Figure 13A:
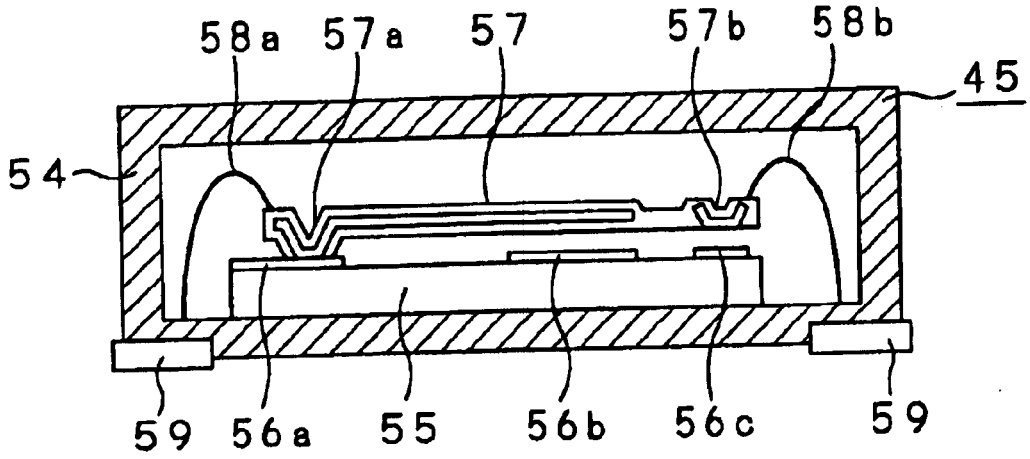
FIG. 13A is a longitudinal sectional view showing a MEMS switch provided in the earth point selection switch.

As mentioned above, an MEMS switch 45 is used for the wireless communication module 40 for short-circuiting to the ground pattern 49 by selecting each selection earth pattern 37. As shown in FIG. 13A, the MEMS switch 45 is entirely covered with an insulating cover 54. In the MEMS switch 45, there are formed a first contact 56*a* through a third contact 56*c* constituting a fixed contact 56 on a silicon substrate 55. A thin-plate, flexible movable contact strip 57 is rotatively supported at the first contact 56*a* in a cantilever fashion. In the MEMS switch 45, the first contact 56*a* and the third contact 56*c* are used as output contacts and are connected to output terminals 59 provided on the insulating cover 54 via leads 58*a* and 58*b*, respectively.

Figure 13B:
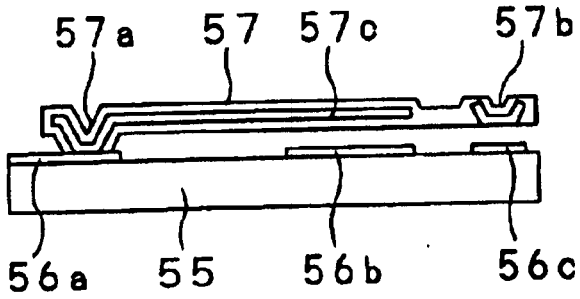
FIG. 13B is a longitudinal sectional view showing the MEMS switch turned off with its cover removed.

The MEMS switch 45 uses one end of the movable contact strip 57 together with a rotation support section to configure a normally closed contact 57*a* with the first contact 56*a* on the silicon substrate 55. The other free end is configured to be a normally open contact 57*b* facing the third contact 56*c*. An electrode 57*c* is provided in the movable contact strip 57 corresponding to a second contact 56*b* at the center. In a normal state of the MEMS switch 45, as shown in FIG. 13B, the movable contact strip 57 keeps the normally closed contact 57*a* contacting the first contact 56*a* and keeps the normally open contact 57*b* contacting the third contact 56*c*.

Figure 13C:
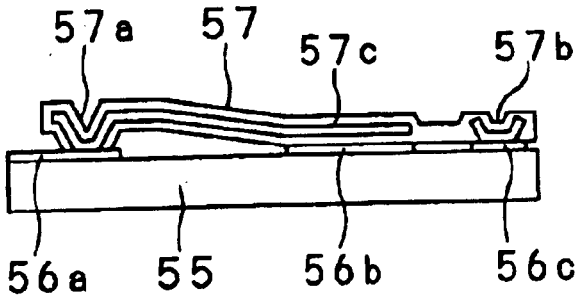

When the specified selection earth pattern 37 is selected, as mentioned above, a drive voltage is applied to the second contact 56*b* and the internal electrode 57*c* in the movable contact strip 57 of the MEMS switch 45. When the drive voltage is applied, the MEMS switch 45 generates a suction force between the second contact 56*b* and the internal electrode 57*c* in the movable contact strip 57. As shown in FIG. 13C, the movable contact strip 57 is displaced toward the silicon substrate 55 pivoting on the first contact 56*a*. When the normally open contact 57*b* of the displaced movable contact strip 57 contacts the third contact 56*c*, the MEMS switch 45 short-circuits the selection earth pattern 37 and the ground pattern 49.

The MEMS switch 45 maintains the short-circuiting state between the selection earth pattern 37 and the ground pattern 49 by maintaining the above-mentioned contact state between the fixed contact 56 and the movable contact strip 57. When another selection earth pattern 37 is selected, the MEMS switch 45 is applied with a reverse bias voltage and restores the movable contact strip 57 to the initial open state. Thus, the MEMS switch 45 causes an open state between the selection earth pattern 37 and the ground pattern 49. The MEMS switch 45 is a very micro switch and requires no holding current for retaining an operation state. When mounted on the wireless communication module 40, the MEMS switch 45 prevents the module from becoming large and can save the power consumption.

Figure 14:
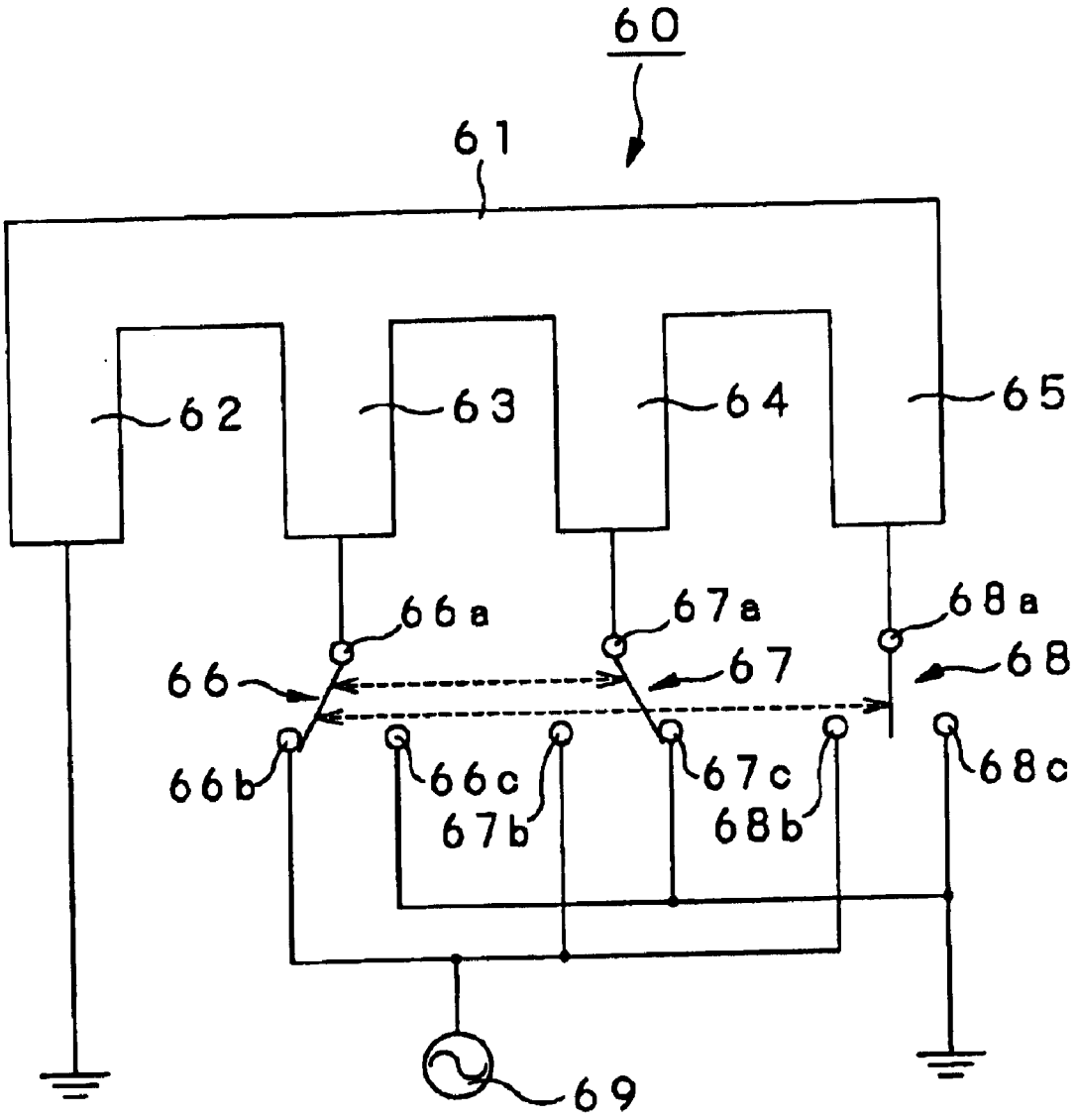
FIG. 14 is a circuit diagram showing an antenna apparatus configured to be capable of switching between a power supply point and an earth point.

Each of the above-mentioned antenna apparatuses is configured to fix the power supply point against the antenna element and make the earth point side variable. Like an antenna apparatus 60 as shown in FIG. 14, the apparatus may be configured to interchange the power supply point and the earth point through selection operations of a switch means. The antenna apparatus 60 comprises an antenna element 61; a fixed earth strip 62 formed orthogonally to one end of the antenna element 61; a first short-circuiting pin 63 through a third short-circuiting pin 65 formed orthogonally to the antenna element 61; and a first selection 66 through a third selection switch 68 respectively connected to these short-circuiting pins.

The antenna apparatus 60 configures a so-called single-pole double-throw switch (SPDT) which provides a changeover operation by interlocking a first selection switch 66 connected to the first short-circuiting pin 63 with a second selection switch 67 connected to a second short-circuiting pin 64 or with a third short-circuiting pin 65 connected to a third selection switch 68. In the antenna apparatus 60, a power supply 69 connects with a normally closed contact 66*b* of the first selection switch 66, a normally open contact 67*b* of the second selection switch 67, and a contact 68*b* of the third selection switch 68. In the antenna apparatus 60, a normally open contact 66*c* of the first selection switch 66, a normally closed contact 67*c* of the second selection switch 67, and a contact 68*c* of the third selection switch 68 are grounded.

As shown in FIG. 14, the antenna apparatus 60 makes connection between a movable contact strip 66*a* and the normally closed contact 66*b* of the first selection switch 66. In this state, a movable contact strip 67*a* of the second selection switch 67 is connected to the normally closed contact 67*c* thereof. Further, a movable contact strip 68*a* of the third selection switch 68 maintains a neutral position. Accordingly, the antenna apparatus 60 configures a power supply pin by connecting the first short-circuiting pin 63 to the power supply 69 via the first selection switch 66. The antenna apparatus 60 configures an earth pin by grounding the second short-circuiting pin 64 via the second selection switch 67. In this state, the antenna apparatus 60 adjusts the resonance frequency as mentioned above by selecting the second selection switch 67 and the third selection switch 68.

When the antenna apparatus 60 maintains the above-mentioned state, the movable contact strip 66*a* of the first selection switch 66 changes from the normally closed contact 66*b* to the normally open contact 66*c*. In interlock with the first selection switch 66, the movable contact strip 67*a* of the second selection switch 67 changes from the normally open contact 67*c* to the normally closed contact 67*b*. In the antenna apparatus 60, the first short-circuiting pin 63 is grounded via the first selection switch 66 to work as an earth pin. In addition, the second short-circuiting pin 64 is connected to the power supply 69 via the second selection switch 67 to work as a power supply pin.

While the antenna apparatus 60 in FIG. 14 has been described according to mechanical operations of the single-pole double-throw switch constituting each selection switch, electronic switch operations may be preferable under program control. The antenna apparatus 60 is not limited to have three sets of short-circuiting pins and selection switches and may contain any number of sets. The antenna apparatus 60 chooses between the power supply point and the earth point according to selection switch operations. In any case, one short-circuiting pin is used as a fixed pin and is connected to the power supply 69 or the ground. The remaining short-circuiting pins are used for selection of circuits to be connected, and connection and disconnection of the ground or the power supply 69 for adjusting the resonance frequency.

The above-mentioned antenna apparatuses use printed circuit boards of various types of materials. Generally, there is used a flame resistant glass-backed epoxy resin copper-clad multilayer substrate with FR (flame retardant) grade 4 as a backing material for printed circuit boards. Printing, etching, and other techniques are used to form specified circuit patterns and antenna patterns. In addition to the above-mentioned FR4 copper-clad multilayer substrate with the specific inductive capacity of approximately 4, there are used composite substrates of polytetrafluoro-ethylene (Teflon as a trade name) and ceramic, ceramic substrates, etc. for printed circuit boards. The antenna apparatus promotes miniaturization by shortening the equivalent wavelength and decreasing the resonance frequency through the use of backing materials with a high specific inductive capacity for printed circuit boards. The antenna apparatus uses Teflon (trade name) substrates with a specific inductive capacity and a low dielectric dissipation factor for a considerably high-frequency band, e.g., 10 GHz or more.

Figure 1:
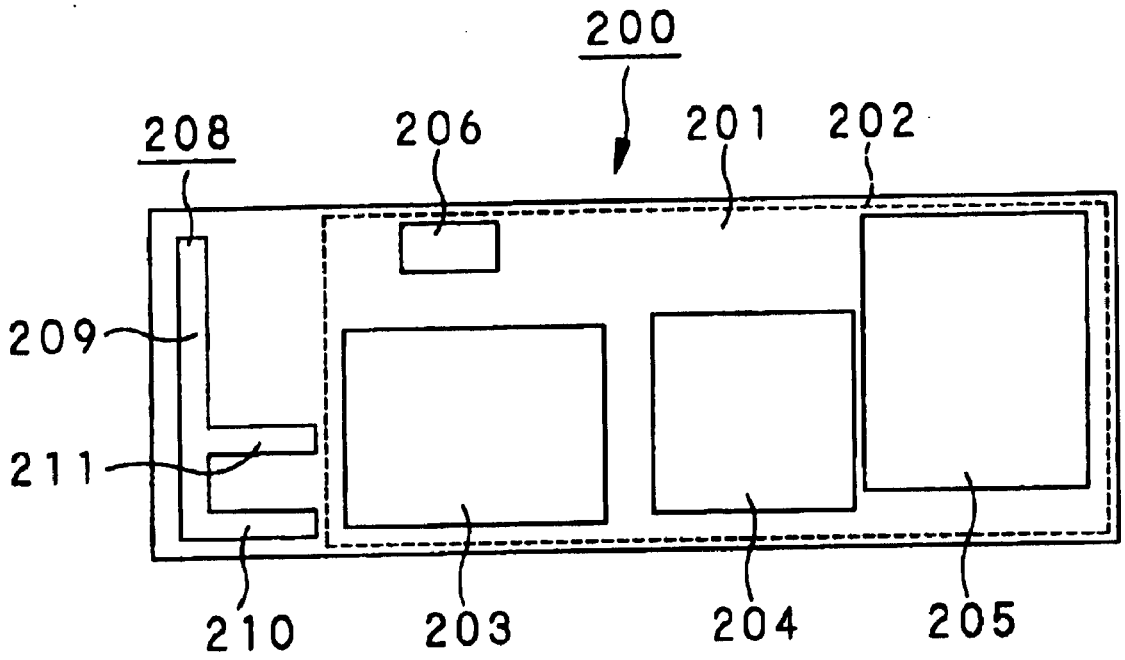
FIG. 1 is a top view showing a wireless communication module having a conventional antenna apparatus.
Figure 2:
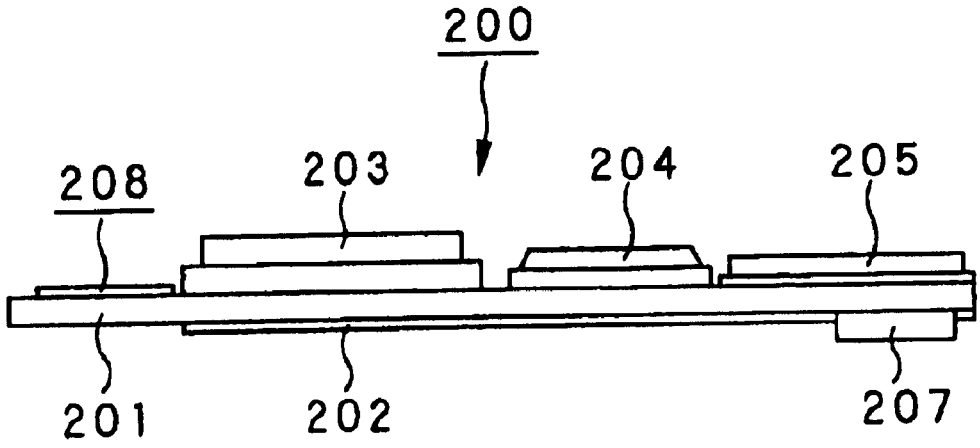
FIG. 2 is a side view showing the wireless communication module in FIG. 1.
Figure 3:
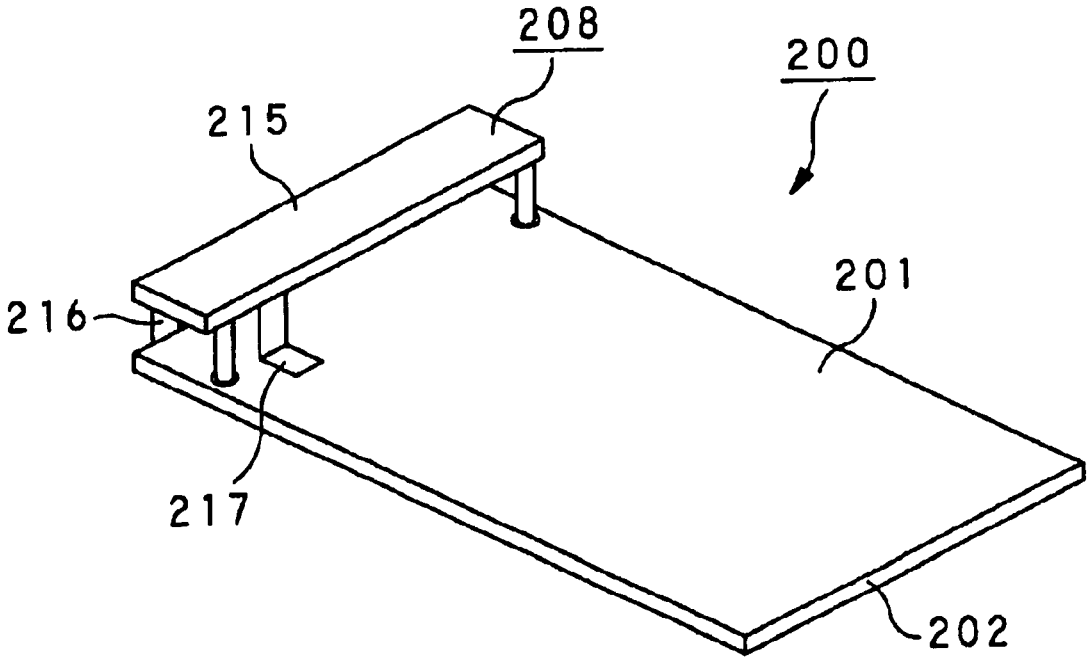
FIG. 3 is a perspective view showing a wireless communication module having a flat antenna.
Figure 4:
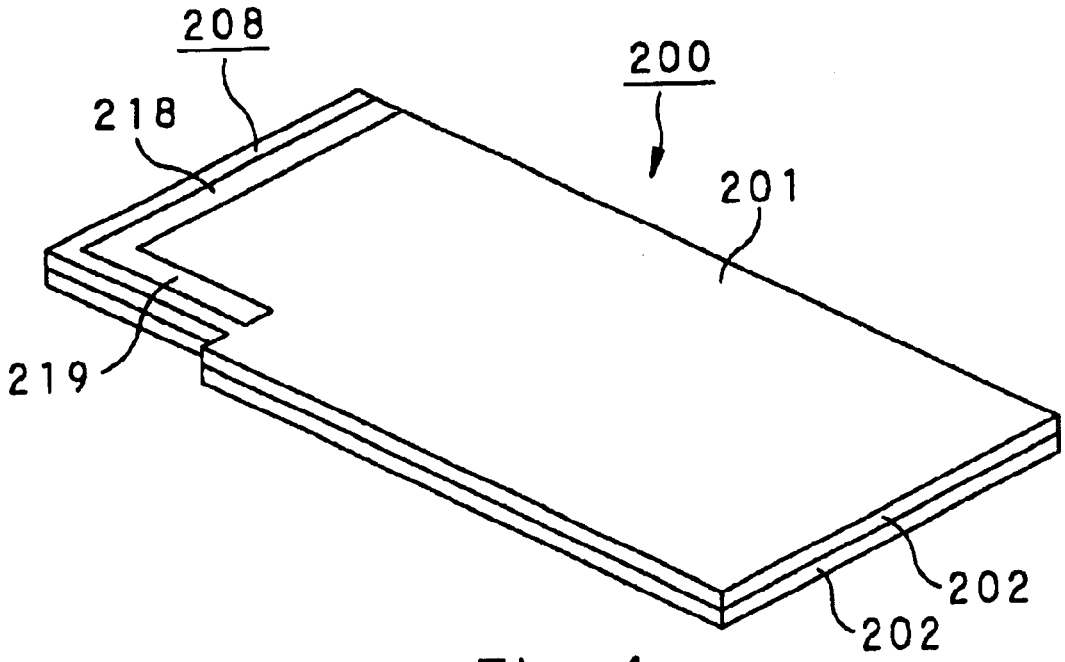
FIG. 4 is a perspective view showing a wireless communication module having a reverse L-shaped antenna.
Figure 15:
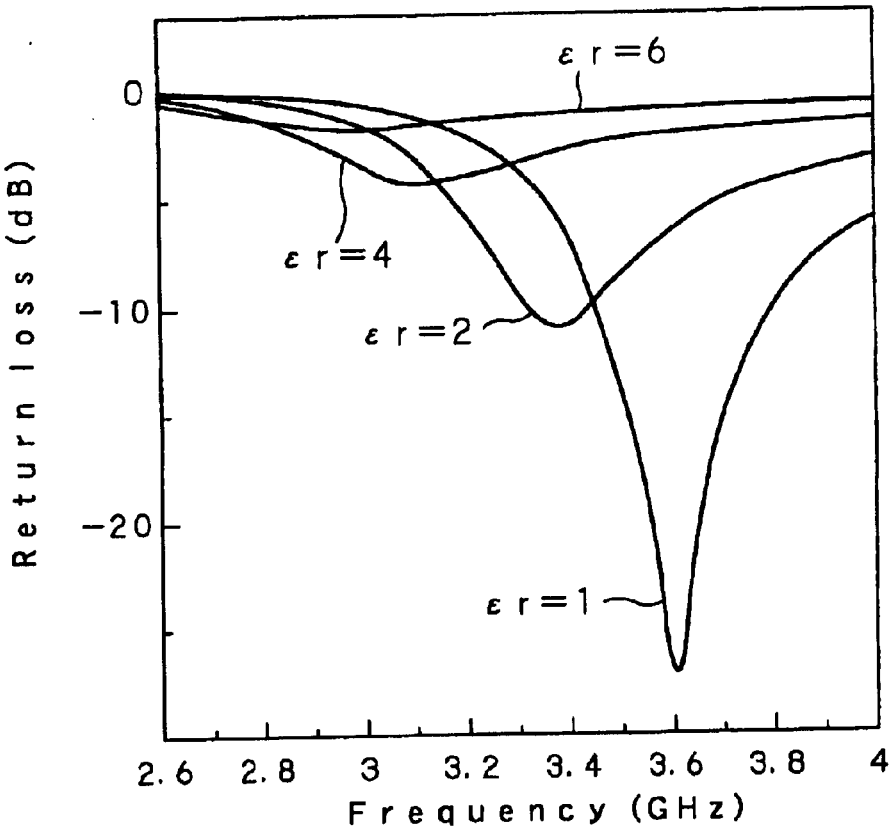
FIG. 15 is a characteristic chart showing a state of resonance frequency changes when a dielectric constant is changed for a printed circuit board.

FIG. 15 shows return loss changes when the above-mentioned wireless communication module 10 uses the printed circuit board 12 with a different material, i.e., with a different dielectric constant E. As shown in FIG. 15, the antenna apparatus causes an impedance matching error because the rate of return loss changes decreases as the dielectric constant E increases. To solve this problem, the antenna apparatus may be largely lifted from the principal plane of the printed circuit board 12 like the flat antenna 5 as shown in FIG. 1 or use the printed circuit board 12 of a material having a small dielectric constant $\epsilon$. However, this makes it difficult to miniaturize the wireless communication module 10.

Figure 16:
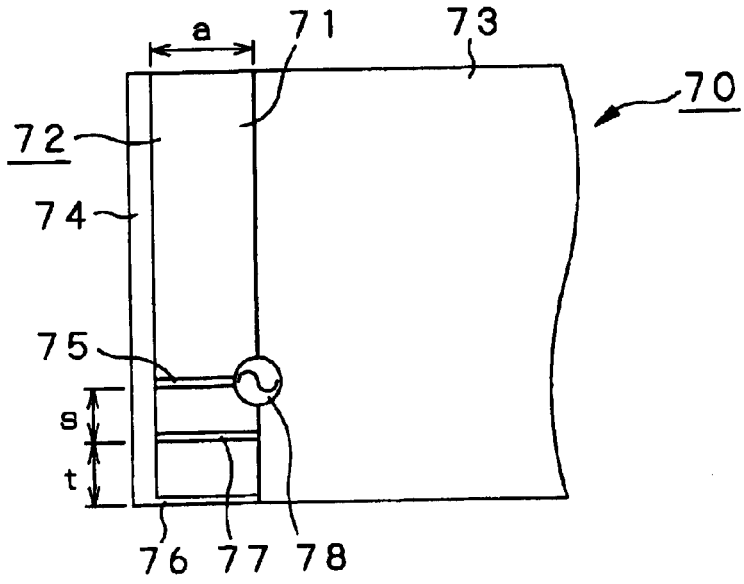
FIG. 16 is a top view showing an antenna apparatus which forms a short-circuiting pin constituting an impedance matching section near a power supply point.

FIG. 16 shows a wireless communication module 70 capable of adjusting an impedance matching error. The wireless communication module 70 forms an adjustment pin 77 for impedance matching on an antenna element 74 between a power supply pin 75 and an earth pin 76. The wireless communication module 70 contains an antenna section 72 patterned on one end of a printed circuit board 71 and a ground pattern 73 on the rear surface. The antenna section 72 employs the basic form of a reverse F-shaped antenna. The antenna section 72 comprises the stick-shaped antenna element 74 formed along one edge of the printed circuit board 71; the power supply pin 75 patterned orthogonally to the antenna element 74 therefrom and connected to a power supply 78; the earth pin 76 patterned orthogonally to the antenna element 74 at one end thereof and short-circuited to the ground pattern 73; and a short-circuiting pin 77 patterned orthogonally to the antenna element 74 between the power supply pin 75 and the earth pin 76. Though not shown in FIG. 16, the wireless communication module 70 is provided with a plurality of selection earth pins and earth selection switches on the antenna element 74 for adjusting the resonance frequency.

Figure 17:
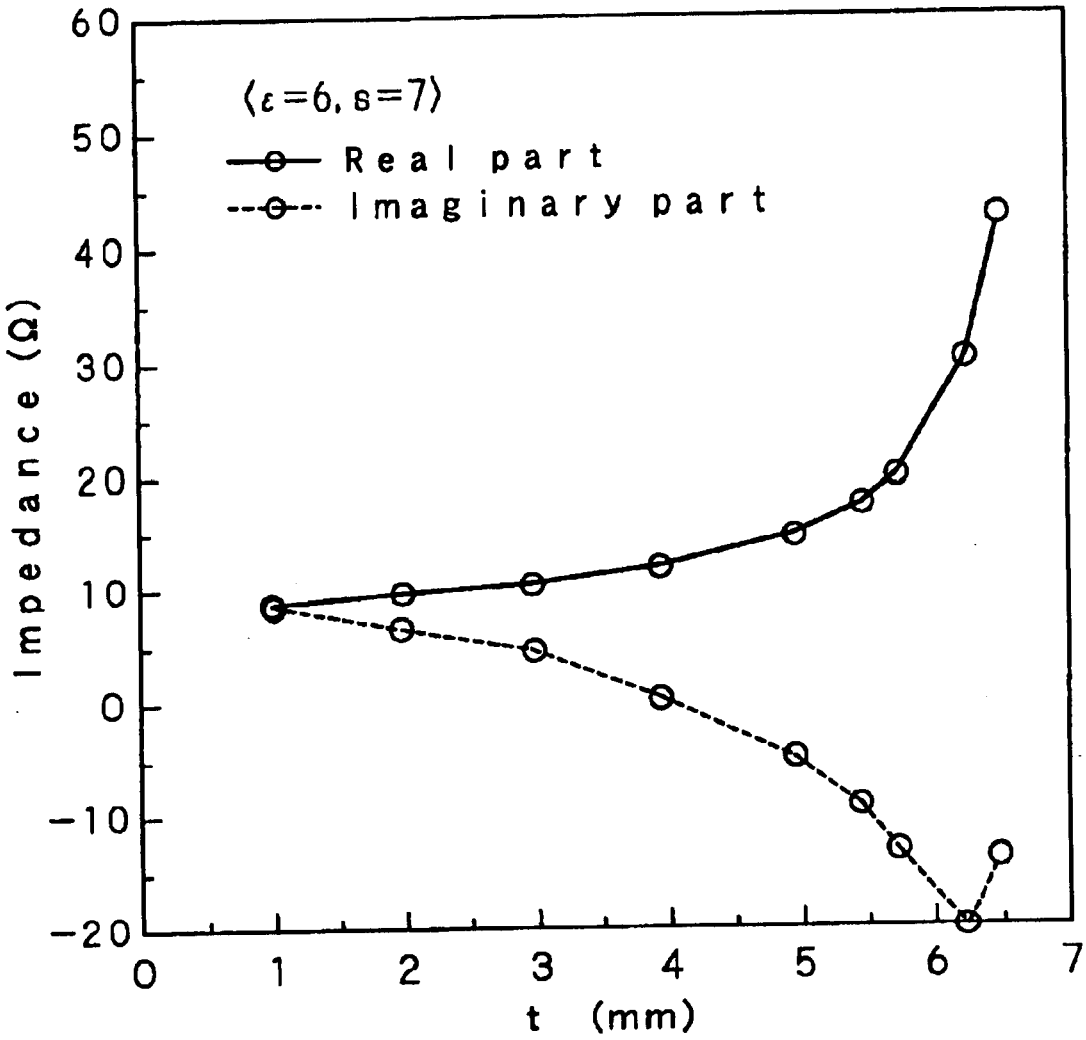
FIG. 17 is a characteristic chart showing a state of impedance changes when a distance between the power supply point and the short-circuiting pin is varied on the antenna apparatus according to the present invention.

In the wireless communication module 70, there is distance a of 5 mm between the ground pattern 73 and the antenna element 74. The printed circuit board 71 has backing dielectric constant $\epsilon$ of 6 and is 1 mm thick. The antenna element 74 is 1 mm wide. The power supply pin 75, the earth pin 76, and the short-circuiting pin 77 each are 0.25 mm wide. There is fixed distance s of 7.0 mm between the power supply pin 75 and the short-circuiting pin 77. FIG. 17 shows impedance changes using distance t between the earth pin 76 and the short-circuiting pin 77 as a parameter. To match the wireless communication module 70 to the 50 Ω antenna impedance, it is optimal to provide distance t of 6.5 mm between the earth pin 76 and the short-circuiting pin 77 as shown in FIG. 17.

Figure 18:
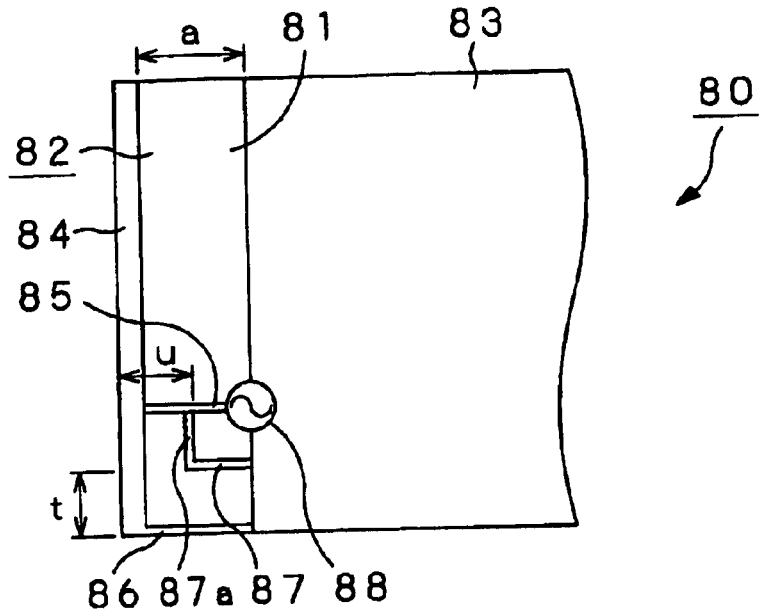
FIG. 18 is a top view showing another example of the antenna apparatus according to the present invention which forms the short-circuiting pin near the power supply point.

Like the wireless communication module 80 in FIG. 18, the antenna apparatus can match the antenna impedance also by divergently forming a short-circuiting pin 87 in the middle of a power supply pin 85. The wireless communication module 80 comprises an antenna section 82 formed on one end of a printed circuit board 81 and a ground pattern 83 formed on the rear surface. The antenna section 82 employs the basic form of a reverse F-shaped antenna. The antenna section 82 comprises a stick-shaped antenna element 84 formed along one edge of the printed circuit board 81; the power supply pin 85 patterned orthogonally to the antenna element 84 therefrom and connected to a power supply 88; and an earth pin 86 patterned orthogonally to the antenna element 84 at one open end and short-circuited to the ground pattern 83.

Figure 19:
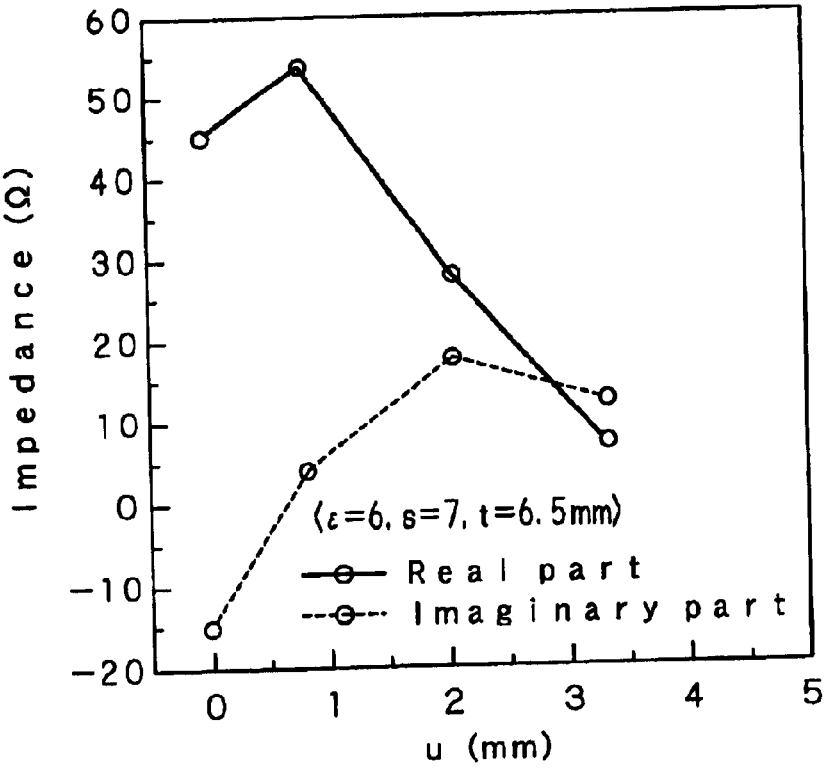
FIG. 19 is a characteristic chart showing a state of impedance changes when a distance between an antenna element and the short-circuiting pin is varied on the antenna apparatus according to the present invention.

In the wireless communication module 80, the short-circuiting pin 87 is patterned so that it extends toward the earth pin 86 in the middle of the power supply pin 85 parallel to the antenna element 84 and bends at right angles toward the ground pattern 83 halfway. The short-circuiting pin 87 contains a rear anchor 87*a* which is formed parallel to the antenna element 84 and maintains distance u against the antenna element 84. Concerning each component, the wireless communication module 80 follows the same specifications as those of the above-mentioned wireless communication module 70 and specifies distance t of 6.5 mm between the earth pin 86 and the short-circuiting pin 87. FIG. 19 shows impedance changes using, as a parameter, distance u between the antenna element 84 and the rear anchor 87*a* of the short-circuiting pin 87 in the wireless communication module 80. To match the wireless communication module 80 to the 50 Ω antenna impedance, it is optimal to provide distance u of 0.85 mm between the antenna element 84 and the rear anchor 87*a* of the short-circuiting pin 87 as shown in FIG. 19.

Figure 20:
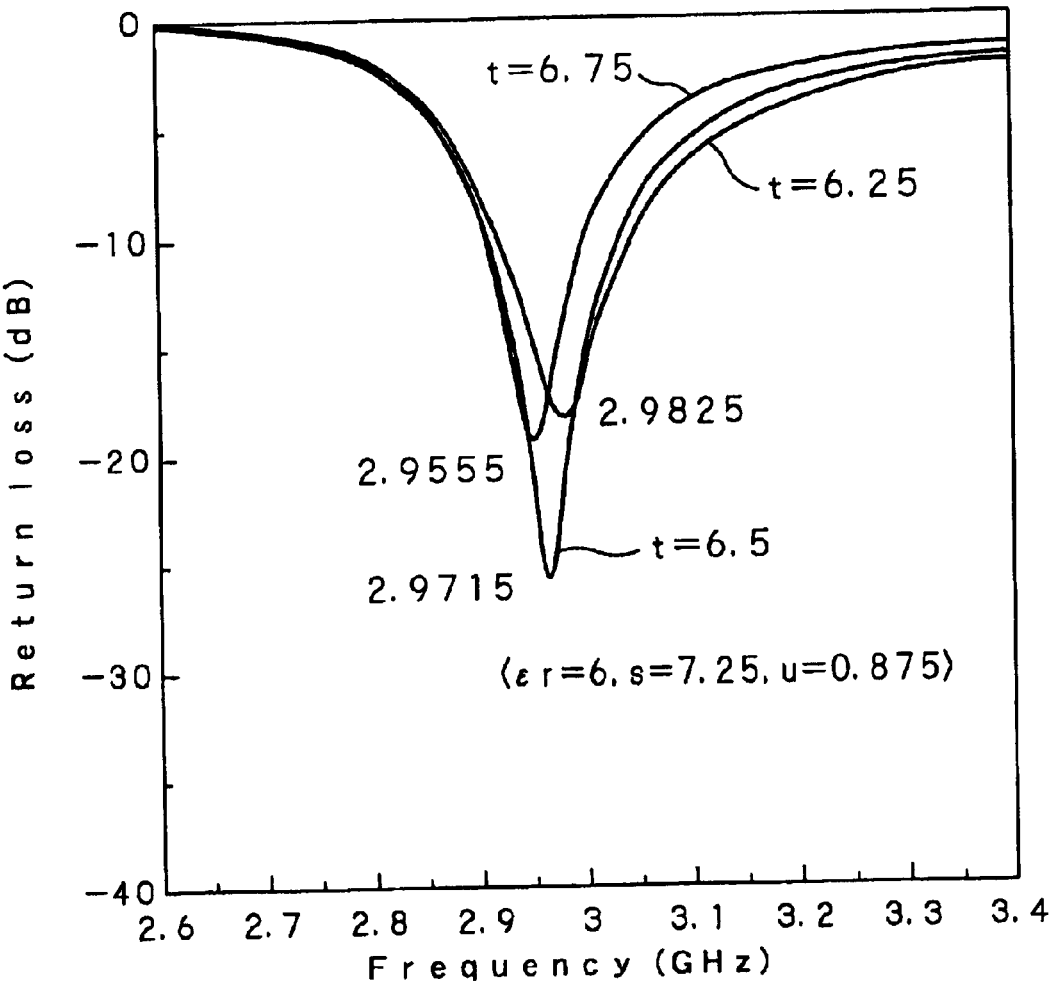
FIG. 20 is a characteristic chart showing a state of resonance frequency changes when a distance between the antenna element's open end and the short-circuiting pin is varied on the antenna apparatus according to the present invention.

FIG. 20 shows antenna resonance frequency changes by setting distance u of 0.85 mm between the antenna element 84 and the rear anchor 87*a* of the short-circuiting pin 87 and using distance t between the earth pin 86 and the short-circuiting pin 87 as a parameter in the wireless communication module 80. As shown in FIG. 20, the wireless communication module 80 allows the impedance matching to change satisfactorily at an antenna resonance frequency approximately between 2.95 GHz and 2.98 GHz, i.e., within a 30 MHz range.

Figure 21:
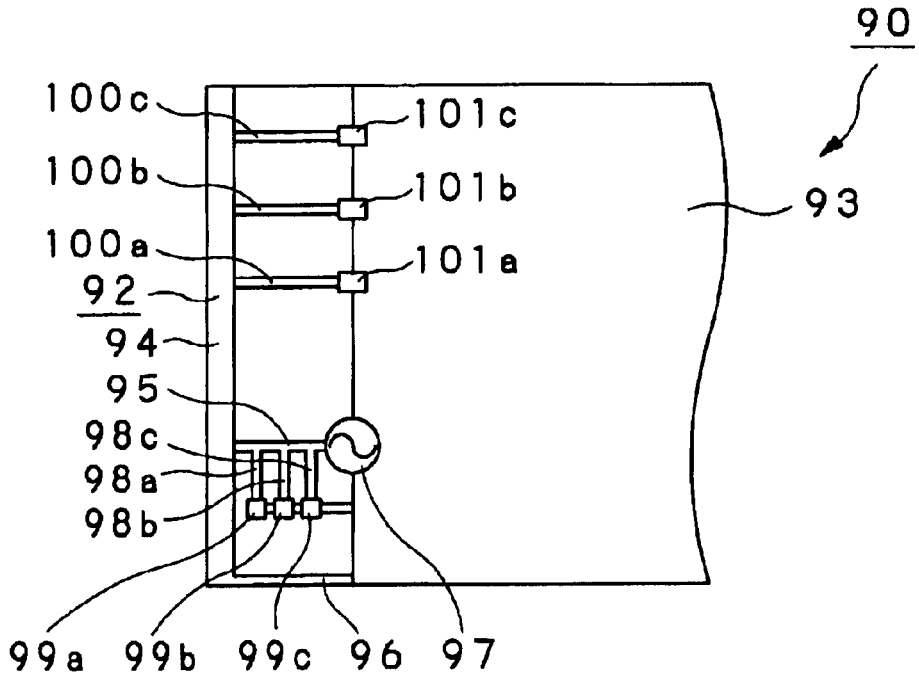
FIG. 21 is a top view showing an antenna apparatus provided with a resonance frequency adjustment section and an impedance matching section.

FIG. 21 shows another example of an wireless communication module 90 having the above-mentioned functions for antenna resonance frequency adjustment and impedance matching. The wireless communication module 90 optimally adjusts the antenna resonance frequency by controlling the impedance matching. The wireless communication module 90 contains an antenna section 92 patterned on one end of a printed circuit board 91 and a ground pattern 93 formed on the rear surface. The antenna section 92 employs the basic form of a reverse F-shaped antenna. The antenna section 92 comprises a stick-shaped antenna element 94 formed along one edge of the printed circuit board 91; a power supply pin 95 patterned orthogonally to the antenna element 94 therefrom and connected to a power supply 97; and an earth pin 96 patterned orthogonally to the antenna element 94 at one open end and short-circuited to the ground pattern 93.

In the wireless communication module 90, first to third impedance matching short-circuiting pins 98*a* through 98*c* are patterned so that they extend toward the earth pin 96 in the middle of the power supply pin 95 parallel to the antenna element 94 and bend at right angles toward the ground pattern 93 halfway. First to third impedance matching switches 99*a* through 99*c* are connected to the impedance matching short-circuiting pins 98*a* through 98*c*. Turning on or off the impedance matching switches 99*a* through 99*c* selectively short-circuits the impedance matching short-circuiting pins 98*a* through 98*c* to the ground pattern 93.

The above-mentioned MEMS switch can be used for the first to third impedance matching switches 99*a* through 99*c*. It is also possible to use a switch comprising active elements such as diodes and transistors, other mechanical switches, etc. for the impedance matching switches 99*a* through 99*c*.

In the wireless communication module 90 to which the present invention is applied, selectively turning on the impedance matching switches 99*a* through 99*c* selects the impedance matching short-circuiting pins 98*a* through 98*c* to be short-circuited to the ground pattern 93 as mentioned above. Accordingly, the wireless communication module 90 uses the selected impedance matching short-circuiting pins 98*a* through 98*c* to adjust a distance between the antenna element 94 and the earth pin 96 for providing the above-mentioned optimal impedance matching.

The wireless communication module 90 to which the present invention is applied includes first to third resonance frequency adjustment short-circuiting pins 100*a* through 100*c* formed at one open end of the antenna element 94 each orthogonally thereto and parallel to the power supply pin 95. First to third earth selection switches 101*a* through 101*c* are connected to the resonance frequency adjustment short-circuiting pins 100*a* through 100*c*. Turning on or off the earth selection switches 101*a* through 101*c* selectively short-circuits the resonance frequency adjustment short-circuiting pins 100*a* through 100*c* to the ground pattern 93. The earth selection switches 101*a* through 101*c* also use the same switches as for the impedance matching switches 99*a* through 99*c*.

As mentioned above, the wireless communication module 90 to which the present invention is applied selectively turns on the earth selection switches 101*a* through 101*c* to select the resonance frequency adjustment short-circuiting pins 100*a* through 100*c* for short-circuiting to the ground pattern 93. Accordingly, the wireless communication module 90 uses the selected resonance frequency adjustment short-circuiting pins 100*a* through 100*c* to adjust a distance between the power supply pin 95 and the earth pin 96 for the above-mentioned resonance frequency adjustment. When the wireless communication module 90 uses, e.g., control signals supplied from a software processing reception system to control operations of the above-mentioned impedance matching switches 99*a* through 99*c* and earth selection switches 101*a* through 101*c*, it is possible to automate the antenna resonance frequency adjustment and the impedance matching.

Figure 22:
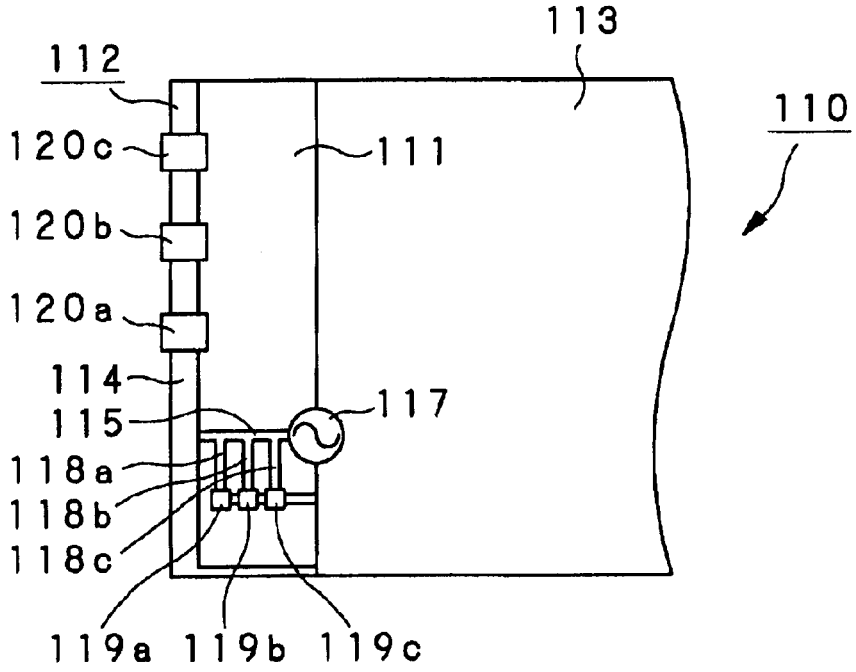
FIG. 22 is a top view showing another example of the antenna apparatus according to the present invention provided with a resonance frequency adjustment section and an impedance matching section.

FIG. 22 shows another example of a wireless communication module 110. Like the above-mentioned wireless communication module 90, the wireless communication module 110 also has the functions for antenna resonance frequency adjustment and impedance matching, and optimally adjusts the antenna resonance frequency by controlling the impedance matching. The wireless communication module 110 in FIG. 22 contains an antenna section 112 patterned on one end of a printed circuit board 111 and a ground pattern 113 formed on the rear surface. The antenna section 112 employs the basic form of a reverse F-shaped antenna. The antenna section 112 comprises a stick-shaped antenna element 114 formed along one edge of the printed circuit board 111; a power supply pin 115 patterned orthogonally to the antenna element 114 and connected to a power supply 117; and an earth pin 116 patterned orthogonally to the antenna element 114 at one open end and short-circuited to the ground pattern 113.

Like the wireless communication module 90, first to third impedance matching short-circuiting pins 118*a* through 118*c* are patterned in the wireless communication module 110. The first to third impedance matching short-circuiting pins 118*a* through 118*c* connect with first to third impedance matching switches 119*a* through 119*c*, respectively. Turning on or off the impedance matching switches 119*a* through 119*c* selectively causes short-circuiting to the ground pattern 113.

On the wireless communication module 110, an antenna element 114 is directly provided with first to third earth selection switches 120*a* through 120*c* with different distances from the power supply pin 115. The wireless communication module 110 adjusts an effective length of the antenna element 114 by turning on or off the earth selection switches 120*a* through 120*c*. The wireless communication module 110 selects the earth selection switches 120*a* through 120*c* to specify an effective length of the antenna element 114 and turns on and off the impedance matching switches 119*a* through 119*c* to determine a predefined impedance matching position. When the wireless communication module 110 also uses control signals supplied from a software processing reception system to control the impedance matching switches 119*a* through 119*c* and earth selection switches 120*a* through 120*c*, it is possible to automate the antenna resonance frequency adjustment and the impedance matching.

The antenna apparatus according to the present invention is not limited to the configuration of the antenna resonance frequency adjustment function and the impedance matching function using the above-mentioned wireless communication module 90 or 100. It may be preferable to apply any combination of the above-mentioned individual configurations to each function.

Industrial Applicability

As mentioned above, the antenna apparatus according to the present invention optimally adjusts the resonance frequency by eliminating adjustment operations depending on changes in the condition of attachment to an electronic device to be mounted, the environmental condition, etc., making it possible to improve the operationality and send and receive data etc. in good condition. The antenna apparatus has the resonance frequency adjustment function and the impedance matching function so as to be applicable to a wireless communication module or the like which is attached to various electronic devices etc. to provide the storage function and the wireless communication function. In such a case, the antenna apparatus can apply to any electronic devices such as main devices with different communication systems or specifications and ensure optimal antenna characteristics, making it possible to highly precisely send and receive data etc. and contribute to the miniaturization of electronic devices themselves.

What is claimed is:

1. An antenna apparatus comprising:

an antenna section having an antenna element provided with at least two or more power supply points and at least two or more earth points;

a power supply point selection switch means which is provided for each of the power supply points and connects or disconnects each power supply point from a power supply section; and an earth point switch means which is provided for each of the earth points and connects or disconnects each earth point from a ground, wherein a resonance frequency is adjusted by allowing one of the power supply point and the earth point to be fixed and the other to be movable, and selecting the power supply point or the earth point which is made to be movable by a selection operation of the power supply point selection switch means or the earth point switch means.

2. The antenna apparatus according to claim 1, wherein the antenna section comprises a flat antenna patterned on a printed circuit board, and wherein the power supply point selection switch means or the earth point switch means is mounted on the printed circuit board.

3. The antenna apparatus according to claim 2, wherein the flat antenna is a monopole antenna including a reverse F-shaped pattern, a reverse L-shaped pattern, a loop pattern, and a micro-split pattern.

4. The antenna apparatus according to claim 1, wherein the antenna section comprises a chip-type antenna which has at least two or more power supply terminals and an earth terminal and is mounted on the printed circuit board; and the power supply terminals and the earth terminal are connected to connection terminals correspondingly formed on the printed circuit board, and are correspondingly pattern-connected to the power supply point selection switch means or the earth point switch means mounted on the printed circuit board via these connection terminals.

5. The antenna apparatus according to claim 1, wherein the power supply point selection switch means and the earth point switch means comprise semiconductor circuits.

6. The antenna apparatus according to claim 1, wherein an MEMS (Micro-Electro-Mechanical-System) switch is used for the power supply point selection switch means and the earth point switch means.

7. The antenna apparatus according to claim 1, wherein there is provided a selection switch means for interchanging the power supply point and the earth point.

8. An antenna apparatus comprising:

an antenna section having an antenna element provided with a power supply point and at least two or more earth points;

an earth point switch means which is provided for each of the earth points and connects or disconnects each earth point from a ground; and an impedance adjustment means which is provided for the power supply point and performs impedance matching, wherein a selection operation of the earth point switch means selects the earth points and adjusts a resonance frequency, and the impedance adjustment means performs impedance matching.

9. The antenna apparatus according to claim 8, wherein the antenna section comprises a flat antenna patterned on a printed circuit board, and wherein the earth point switch means are mounted on the printed circuit board.

10. The antenna apparatus according to claim 8, wherein the flat antenna is a monopole antenna including a reverse F-shaped pattern, a reverse L-shaped pattern, a loop pattern, and a micro-split pattern.

11. The antenna apparatus according to claim 8, wherein the antenna section comprises a chip-type antenna which has a power supply terminal and at least two or more earth terminals and is mounted on the printed circuit board; and the power supply terminal and the earth terminals connected to connection terminals correspondingly formed on the printed circuit board, and are correspondingly pattern-connected to the earth point switch means mounted on the printed circuit board via these connection terminals.

12. The antenna apparatus according to claim 8, wherein the impedance adjustment means comprises a short-circuiting point branched from the power supply point and an impedance adjustment switch means which is provided in pairs with each of the earth point switch means and changes a state of connection between the short-circuiting point and the power supply section; and the impedance adjustment switch means is selected corresponding to the selected earth point switch means and is connected to the power supply section to perform resonance frequency adjustment and impedance matching.

13. The antenna apparatus according to claim 12, wherein the earth point switch means and/or the impedance adjustment switch means comprise semiconductor circuits.

14. The antenna apparatus according to claim 12, wherein an MEMS (Micro-Electro-Mechanical-System) is used for the earth point switch means and/or the impedance adjustment switch means.

15. The antenna apparatus according to claim 8, wherein there is provided a selection switch means for interchanging the power supply point and the earth point.

* * * * *

UNITED STATES PATENT AND TRADEMARK OFFICE

CERTIFICATE OF CORRECTION

PATENT NO. : 6,753,815 B2
DATED : June 29, 2004
INVENTOR(S) : Scott Van De Graaff It is certified that error appears in the above-identified patent and that said Letters Patent is hereby corrected as shown below:

Title page,
Item [73], Assignee, should read:
-- Micron Technology, Inc., Boise, ID (U.S.) --

Signed and Sealed this

Twenty-first Day of September, 2004

JON W. DUDAS
*Director of the United States Patent and Trademark Office*